US009142181B2

(12) United States Patent
Kuo et al.

(10) Patent No.: US 9,142,181 B2
(45) Date of Patent: Sep. 22, 2015

(54) DISPLAY DRIVER AND DISPLAY DIVING METHOD

(71) Applicant: NOVATEK Microelectronics Corp., Hsin-Chu (TW)

(72) Inventors: Chia-Hsun Kuo, Hsinchu (TW); Chia-Wei Su, Hsinchu (TW); Ji-Ting Chen, Hsinchu County (TW); Shun-Hsun Yang, Hsinchu (TW); Wei-Hsiang Hung, Hsinchu (TW); Ying-Zu Lin, Taichung (TW); Li-Tang Lin, Hsinchu (TW)

(73) Assignee: NOVATEK Microelectronics Corp., Hsinchu Science Park, Hsin-Chu (TW)

( * ) Notice: Subject to any disclaimer, the term of this patent is extended or adjusted under 35 U.S.C. 154(b) by 53 days.

(21) Appl. No.: 13/964,121

(22) Filed: Aug. 12, 2013

(65) Prior Publication Data

US 2014/0320474 A1 Oct. 30, 2014

(30) Foreign Application Priority Data

Apr. 26, 2013 (TW) ..... 102115057 A

(51) Int. Cl.
*G09G 3/36* (2006.01)

(52) U.S. Cl.
CPC ..... *G09G 3/3688* (2013.01); *G09G 2310/027* (2013.01); *G09G 2310/0248* (2013.01); *G09G 2310/0289* (2013.01); *G09G 2330/021* (2013.01); *G09G 2330/023* (2013.01)

(58) Field of Classification Search
CPC . G09G 3/3685; G09G 3/3688; G09G 3/3696; G09G 2310/0243; G09G 2310/0248; G09G 2310/0251; G09G 2310/0264; G09G 2310/027; G09G 2310/0272; G09G 2310/0291
See application file for complete search history.

(56) References Cited

U.S. PATENT DOCUMENTS

| | | | | |
|---|---|---|---|---|
| 7,327,344 | B2 * | 2/2008 | Asada et al. | 345/100 |
| 7,573,470 | B2 | 8/2009 | Hong | |
| 7,643,002 | B2 * | 1/2010 | Kang et al. | 345/100 |
| 7,683,870 | B2 * | 3/2010 | Kang et al. | 345/89 |
| 8,130,218 | B2 * | 3/2012 | Chen et al. | 345/215 |
| 8,415,957 | B2 * | 4/2013 | Huang et al. | 324/658 |
| 8,711,079 | B2 * | 4/2014 | Lee et al. | 345/100 |
| 2002/0041245 | A1 * | 4/2002 | Brownlow et al. | 341/145 |
| 2004/0178981 | A1 * | 9/2004 | Asada et al. | 345/96 |
| 2005/0007324 | A1 * | 1/2005 | Inada | 345/87 |
| 2005/0052890 | A1 * | 3/2005 | Morita | 365/87 |
| 2005/0078078 | A1 * | 4/2005 | Morita | 345/100 |
| 2006/0232539 | A1 * | 10/2006 | Hashimoto | 345/96 |

(Continued)

FOREIGN PATENT DOCUMENTS

| | | |
|---|---|---|
| TW | I277055 | 3/2007 |
| TW | I288906 | 10/2007 |
| TW | I336459 | 1/2011 |

*Primary Examiner* — Patrick F Marinelli
(74) *Attorney, Agent, or Firm* — Winston Hsu; Scott Margo

(57) ABSTRACT

A display driver, which comprises: a first predetermined voltage level providing apparatus, for providing a first predetermined voltage level group comprising at least one first predetermined voltage level; a first image data providing apparatus, for outputting a first image data; and a detection controlling circuit, for determining if an output terminal of the first image data providing apparatus is pre-charged to the first predetermined voltage level according to a relation between an absolute value of a voltage level of the first image data and an absolute value of the first predetermined voltage level.

56 Claims, 27 Drawing Sheets

(56) References Cited

U.S. PATENT DOCUMENTS

| | | | | |
|---|---|---|---|---|
| 2006/0290637 | A1* | 12/2006 | Kang et al. | 345/98 |
| 2006/0290638 | A1* | 12/2006 | Kang et al. | 345/98 |
| 2006/0291298 | A1* | 12/2006 | Kang et al. | 365/189.07 |
| 2007/0115243 | A1* | 5/2007 | Kim et al. | 345/100 |
| 2008/0122777 | A1* | 5/2008 | Kuo et al. | 345/98 |
| 2008/0231580 | A1* | 9/2008 | Hsu | 345/98 |
| 2008/0284771 | A1* | 11/2008 | Matsuki | 345/211 |
| 2009/0027322 | A1* | 1/2009 | Hosotani | 345/87 |
| 2010/0164929 | A1* | 7/2010 | Chen et al. | 345/211 |
| 2011/0001491 | A1* | 1/2011 | Huang et al. | 324/658 |
| 2012/0160104 | A1* | 6/2012 | Vulfson | 95/273 |
| 2013/0207958 | A1* | 8/2013 | Lee et al. | 345/212 |
| 2013/0257917 | A1* | 10/2013 | Peng et al. | 345/690 |
| 2014/0160104 | A1* | 6/2014 | Lin et al. | 345/212 |
| 2014/0160107 | A1* | 6/2014 | Lo et al. | 345/212 |
| 2014/0247257 | A1* | 9/2014 | Li et al. | 345/209 |

* cited by examiner

DISPLAY DRIVER AND DISPLAY DIVING METHOD

BACKGROUND OF THE INVENTION

1. Field of the Invention

The present invention relates to a display driver and a display driving method, and particularly relates to a display driver and a display driving method which can avoid thermal energy generation via pre-charging.

2. Description of the Prior Art

A driving chip for a LCD (liquid crystal display) always comprises two main parts: a source driver and a gate driver. The gate driver controls turning on/off operations for the TFT (thin film transistor) in the LCD. Also, the source driver transmits image data (the gray level necessary for displaying an image) to the LCD after the TFT is conductive.

FIG. 1 is a circuit diagram illustrating a source driver for prior art. As shown in FIG. 1, the source driver 100 comprises an amplifier $OP_1$ and a switch device $SW_1$. The equivalent resistor $R_1$ and the equivalent capacitor $C_1$ indicate the equivalent resistance and the equivalent capacitance for the LCD. The amplifier $OP_1$ outputs the image data signal $IS_1$ to the LCD. However, for such structure, if an output terminal of the amplifier $OP_1$ is pulled up or pulled down to a voltage that the image data needs (ex. $VT_1$ or $VT_2$ in FIG. 2), all current generated by the pulling up or pulling down operation must flow through the resistor for the amplifier $OP_1$ itself and the switch device $SW_1$ at the output terminal of the amplifier $OP_1$. Therefore, larger thermal energy is generated.

SUMMARY OF THE INVENTION

Therefore, one objective of the present invention is to generate a display driver that can generate less thermal energy.

Another objective of the present invention is to provide a display driving method that can generate less thermal energy.

One embodiment of the present invention discloses a display driver, which comprises: a first predetermined voltage level providing apparatus, for providing a first predetermined voltage level group comprising at least one first predetermined voltage level; a first image data providing apparatus, for outputting a first image data; and a detection controlling circuit, for determining if an output terminal of the first image data providing apparatus is pre-charged to the first predetermined voltage level according to a relation between an absolute value of a voltage level of the first image data and an absolute value of the first predetermined voltage level.

Another embodiment of the present invention discloses a display driver, which comprises: a first predetermined voltage level providing apparatus, for providing a first predetermined voltage level group comprising at least one first predetermined voltage level; a second predetermined voltage level providing apparatus, for providing a second predetermined voltage level group comprising at least one second predetermined voltage level, wherein a polarity of the second predetermined voltage level is opposite to which of the first predetermined voltage level, or an absolute value of the second predetermined voltage level is smaller than which of the first predetermined voltage level; a first image data providing apparatus, for outputting a first image data; and a detection controlling circuit, for determining if an output terminal of the first image data providing apparatus is pre-charged to the second predetermined voltage level according to a relation between an absolute value of a voltage level of the first image data and an absolute value of the first predetermined voltage level.

At least one display driving method can be acquired according to above-mentioned embodiments. The detail steps thereof are omitted for brevity here.

In view of above-mentioned embodiments, the output terminal of the image data providing apparatus can be pre-charged to a predetermined level before the image data providing apparatus outputs the data according to the characteristic of the image data. By this way, the current generated via the charging operation can only flow through a switch rather than flow through a plurality of resistors such as the prior art, thus the generation for thermal energy can be decreased. Also, the charge sharing operation can be performed via the detection controlling circuit, even the polarity inversing is not performed. Thereby not only the power can be saved but also the range for pre-charging or charging can be decreased, such that the generation for thermal energy can be decreased as well.

These and other objectives of the present invention will no doubt become obvious to those of ordinary skill in the art after reading the following detailed description of the preferred embodiment that is illustrated in the various figures and drawings.

DETAILED DESCRIPTION

Figure 3:
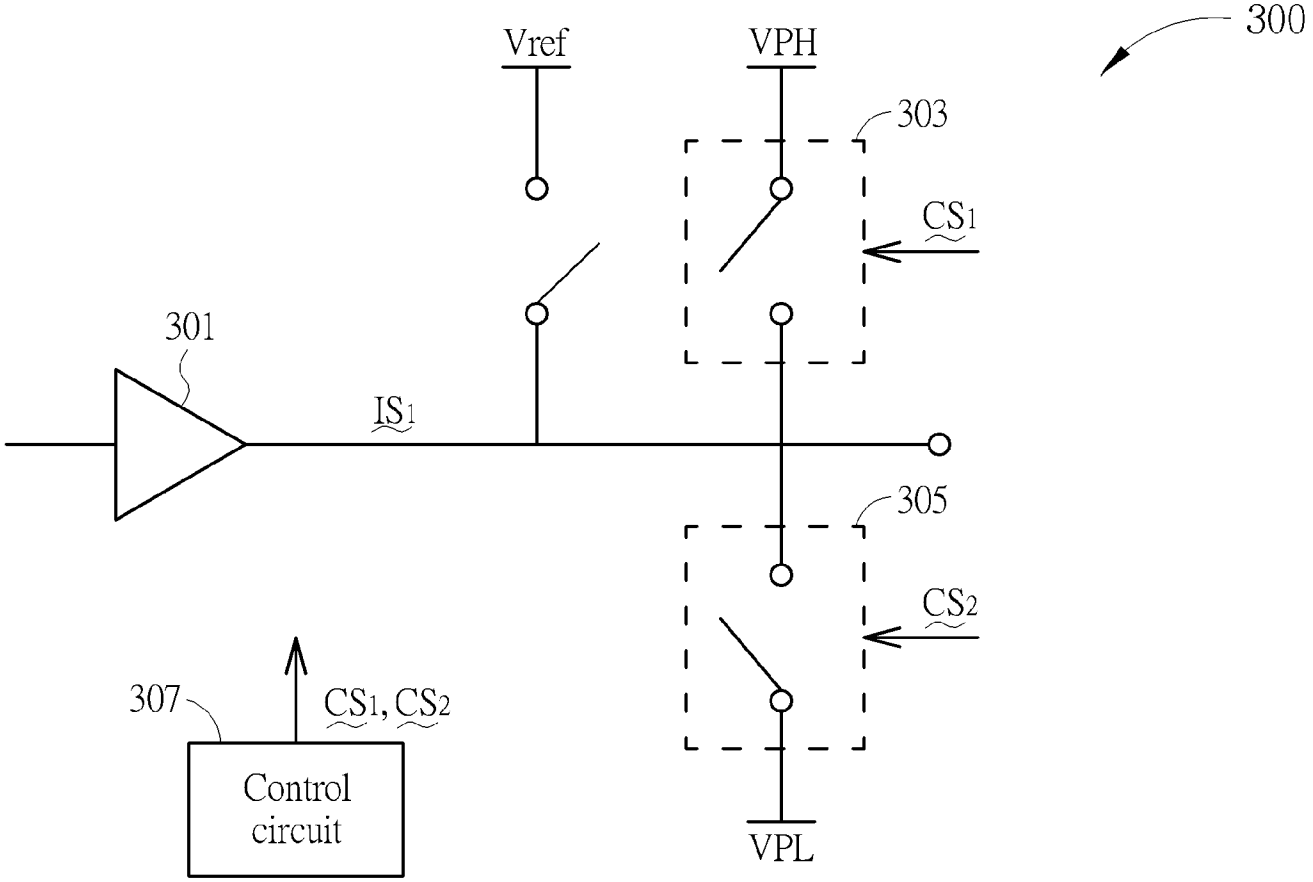
FIG. 3 is a circuit diagram illustrating a single channel source driver according to one embodiment of the present invention.

FIG. 3 is a circuit diagram illustrating a single channel source driver 300 according to one embodiment of the present invention. As shown in FIG. 3, the single channel source driver 300 comprises: a first predetermined voltage level providing apparatus 301 (an amplifier in this example), a predetermined voltage level providing apparatus 303, a predetermined voltage level providing apparatus 305 and a detection controlling circuit 307. The first image data providing apparatus 301 outputs a first image data $IS_1$. The predetermined voltage level providing apparatus 303 provides a high predetermined voltage level VPH, and the predetermined voltage level providing apparatus 305 provides a low predetermined voltage level VPL. The polarity of the high predetermined voltage level VPH is opposite to which of the low predetermined voltage level VPL. For example, the high predetermined voltage level VPH is +1.8V, and the low predetermined voltage level VPH is −1.8V (not limited). The detection controlling circuit 307 determines if an output terminal of the first image data providing apparatus 301 is pre-charged to the high predetermined voltage level VPH or the low predetermined voltage level VPL (i.e. control the switches of the predetermined voltage level providing apparatus 303 or the predetermined voltage level providing apparatus 305) according to a relation between a voltage level of the first image data $IS_1$ and the high predetermined voltage level VPH or the low predetermined voltage level VPL. Please note the source driver 300 is not limited to comprise both the high predetermined voltage level VPH and the low predetermined voltage level VPL. The source driver 300 can comprise only one of the high predetermined voltage level VPH and the low predetermined voltage level VPL. Additionally, the detection controlling circuit 307 can further determine if an output terminal of the first image data providing apparatus 301 is pre-charged to the high predetermined voltage level VPH, the low predetermined voltage level VPL or the reference voltage level $V_{ref}$ according to a relation between a voltage level of the first image data $IS_1$ and the reference voltage level $V_{ref}$. Many circuits can be applied for the detection controlling circuit 307. For example, the detection controlling circuit 307 can comprise a plurality of logic gates such that the detection controlling circuit 307 can automatically generate different control signals to perform the control operation according to received signals. Alternatively, firmware can be written to a device such as the micro processor to perform the control operation. Besides, the predetermined voltage level providing apparatus 303 is not limited to provide a single voltage level, it can provide a voltage level group comprising at least one high predetermined voltage level VPH. Similarly, the predetermined voltage level providing apparatus 305 is not limited to provide a single voltage level, it can provide a single voltage level comprising at least one low predetermined voltage level VPL.

The operation for the source driver 300 is described for more detail as below. In a LCD, the polarities of the liquid crystal devices are sometimes inversed for avoid breaking for the liquid crystal devices. In such situation, the image data level varies from positive to negative, or negative to positive. FIG. 4-FIG. 31 are schematic diagrams illustrating the operation for the single channel source driver according to one embodiment of the present invention when the single channel source driver performs polarity inversing. In the following embodiment, the high predetermined voltage level VPH is positive and the low predetermined voltage level VPL. Also, the reference voltage level $V_{ref}$, which can be 0 or other values, is between the high predetermined voltage level VPH and the low predetermined voltage level VPL. The device for providing the reference voltage level $V_{ref}$ shown in FIG. 3 is only for example. Persons skilled in the art can easily understand other structures for providing the reference voltage level $V_{ref}$ according to the teaching of the present invention while processing image data. Please note the source driver of the present invention can only comprise one of the reference voltage level $V_{ref}$, the high predetermined voltage level VPH, and the low predetermined voltage level VPL.

The embodiments shown in FIG. 4 to FIG. 31 comprise different characteristics, which comprise: which voltage is the first predetermined voltage for determining if pre-charging operation should be performed or not? (can be one of the high predetermined voltage level VPH, the low predetermined voltage level VPL and the reference voltage level $V_{ref}$); which voltage is the output terminal of the source driver pre-charged to, it can be the first predetermined voltage level or the second predetermined voltage level different; if the output terminal is charged to another voltage after pre-charged to the first predetermined voltage level or the second predetermined voltage level, and then charged to a target voltage level; the value of the target voltage level $V_T$.

Figure 1:
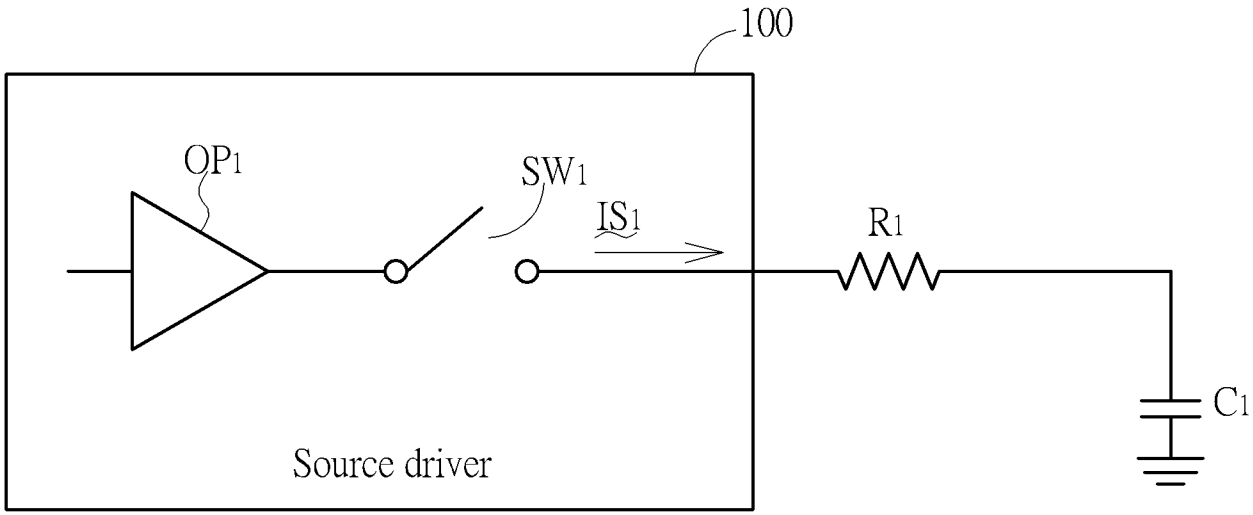
FIG. 1 PRIOR ART
FIG. 1 is a circuit diagram illustrating a source driver for prior art.
Figure 2:
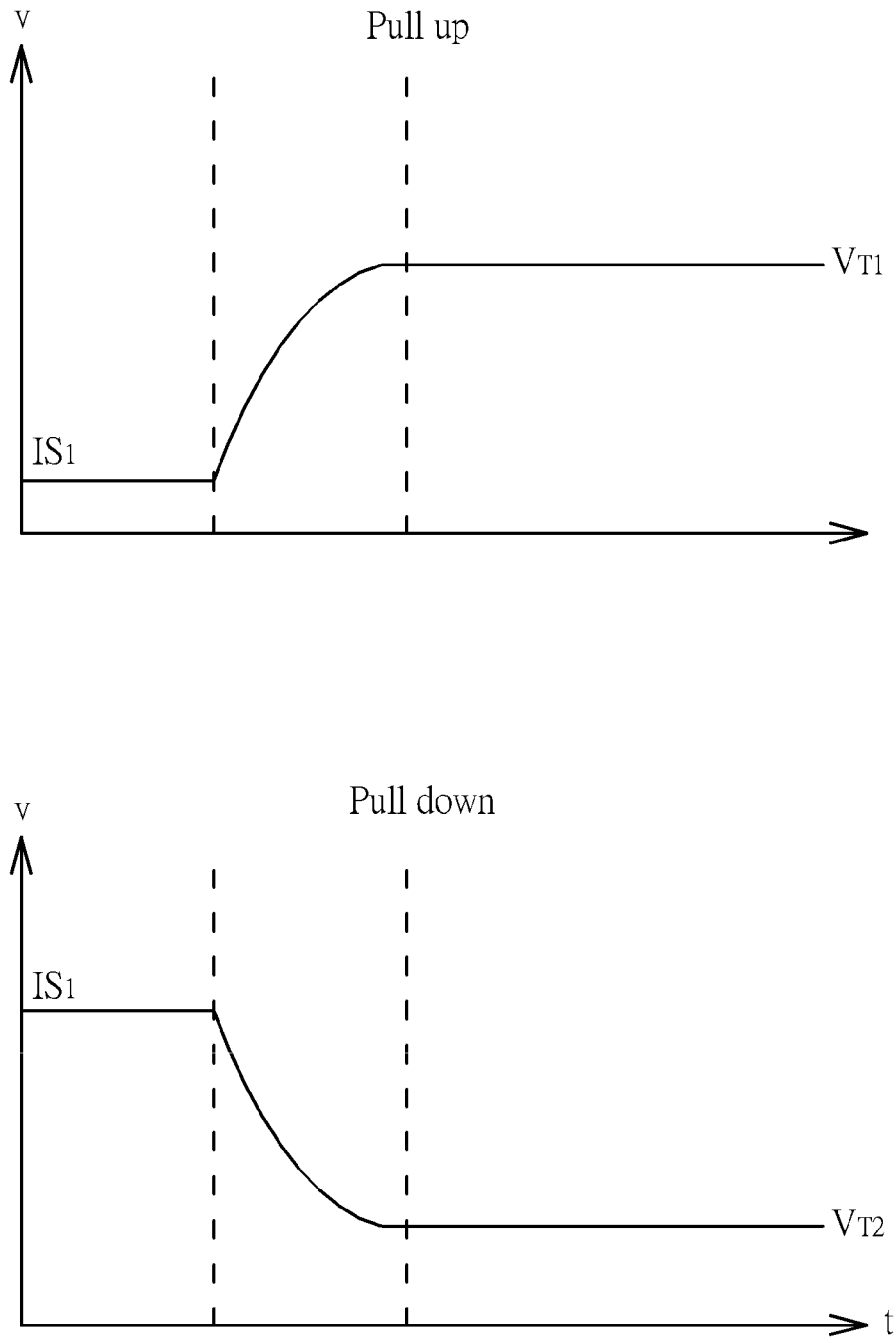
FIG. 2 PRIOR ART
FIG. 2 is a schematic diagram illustrating the operation for the source driver shown in FIG. 1.
Figure 4:
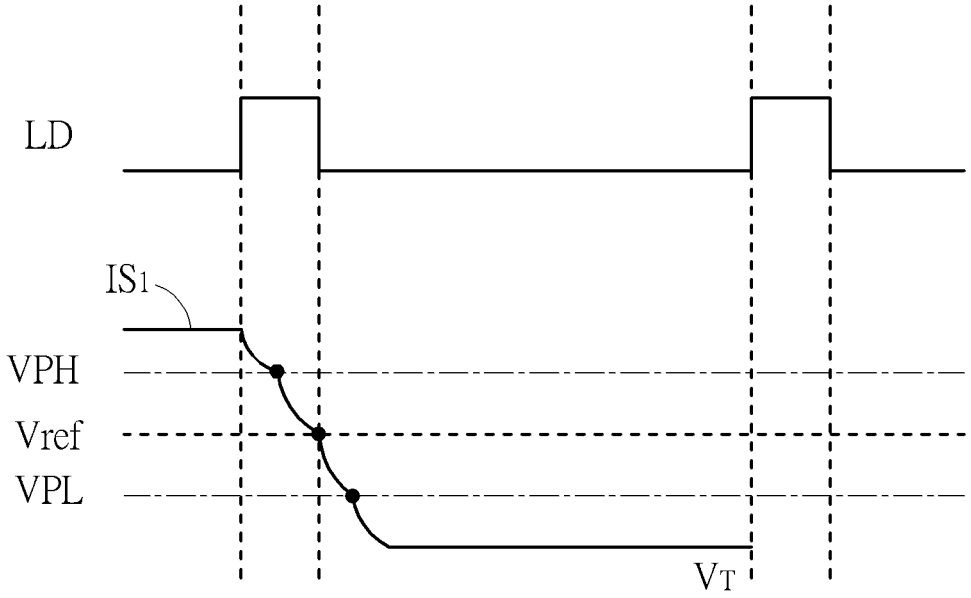
FIG. 4-FIG. 31 are schematic diagrams illustrating the operation for the single channel source driver according to one embodiment of the present invention when the single channel source driver performs polarity inversing.
Figure 5:
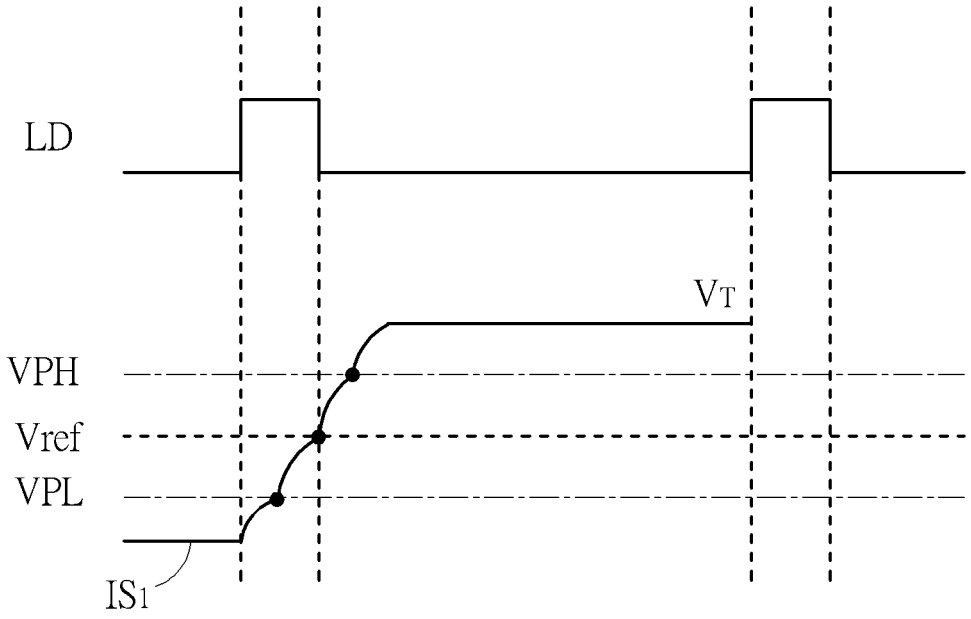

In the embodiment of FIG. 4, the voltage level for the first image data $IS_1$ is positive, and the absolute value thereof is larger than which of the high predetermined voltage level VPH. Also, the voltage level for the target voltage level $V_T$ is negative and the absolute value thereof is larger than which of the low predetermined voltage level VPL. Therefore the voltage level which is pre-charged to may be the voltages between the first image data $IS_1$ and the target voltage level $V_T$. That is, the high predetermined voltage level VPH, the low predetermined voltage level VPL, or the reference voltage level $V_{ref}$. Please note, the voltage level which is pre-charged to can vary corresponding to the target voltage level $V_T$. For example, the voltage level which is pre-charged to can be determined according to "how to generate minimum thermal energy for the switch device $SW_1$ in FIG. 1", but not limited. For example, of the target voltage level $V_T$ is between the reference voltage level $V_{ref}$ and the low predetermined voltage level VPL, it does not need to pre-charge the output terminal of the source driver to the low predetermined voltage level VPL. The high predetermined voltage level VPH is utilized as the first predetermined voltage level in the embodiment of FIG. 4, if the voltage level of the first image data $IS_1$ is determined to be higher than the high predetermined voltage level VPH, the output terminal of the source driver is pre-charged to the high predetermined voltage level VPH. Also, the output terminal is charged to the reference voltage level $V_{ref}$ after being pre-charged to the high predetermined voltage level VPH, then charged to the low predetermined voltage level VPL and then charged to the target voltage level $V_T$. The embodiment shown in FIG. 5 has inversed phase but the same logic as which of the embodiment shown in FIG. 4. That is, the low predetermined voltage level VPL is utilized as the first predetermined voltage level in FIG. 5, but FIG. 5 has an operation logic the same as which of FIG. 4. The figures for FIG. 4 and FIG. 5 are symmetric, but the positive/negative for the first image data $IS_1$ and the target voltage level $V_T$ in FIG. 5 are opposite as which in FIG. 4.

Figure 6:
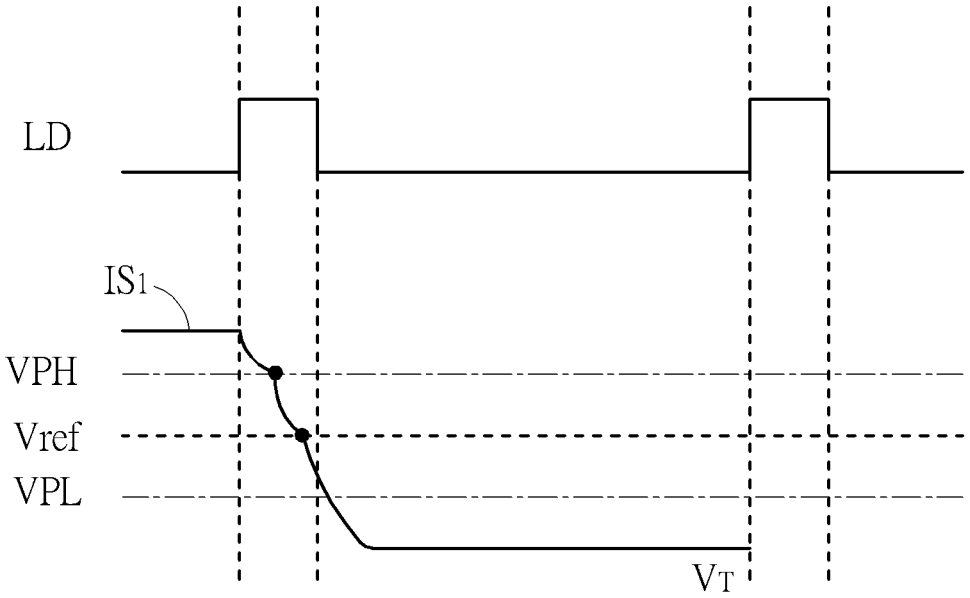
Figure 7:
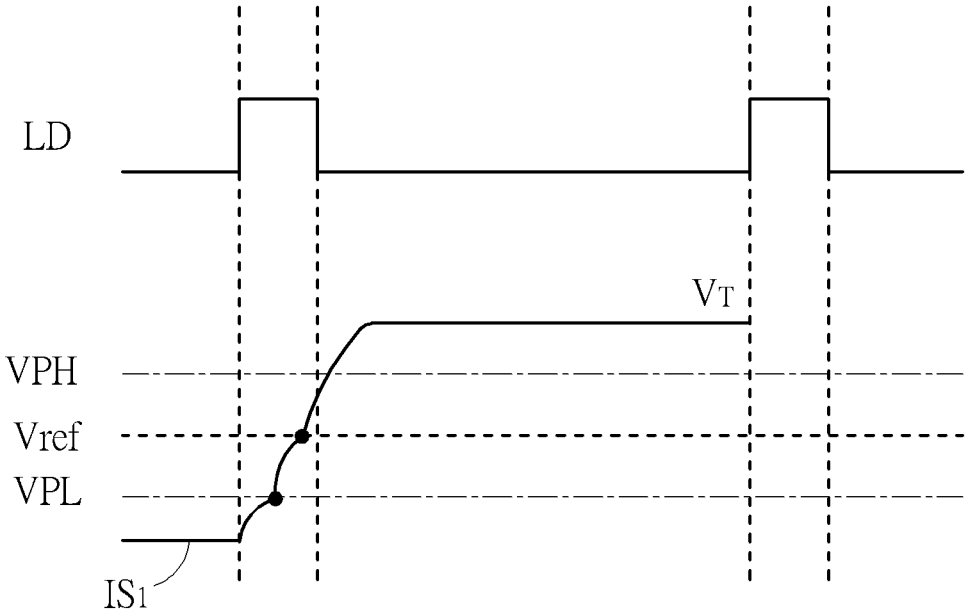

In the embodiment shown in FIG. 6, the voltage level for the first image data $IS_1$ is positive, and the absolute value thereof is larger than which of the high predetermined voltage level VPH. Also, the target voltage level VT is negative and the absolute value thereof is larger than which of the low predetermined voltage level VPL. Therefore, the voltage level that is possibly to be pre-charged to is the same as the embodiment of FIG. 4. The embodiment in FIG. 6 also utilizes the high predetermined voltage level VPH as the first predetermined voltage level. However, after pre-charges to the high predetermined voltage level VPH, the embodiment in FIG. 6 charges to the reference voltage level $V_{ref}$ rather than the low predetermined voltage level VPL and then charges to the target voltage level $V_T$. The phase of the embodiment in FIG.

Figure 11:
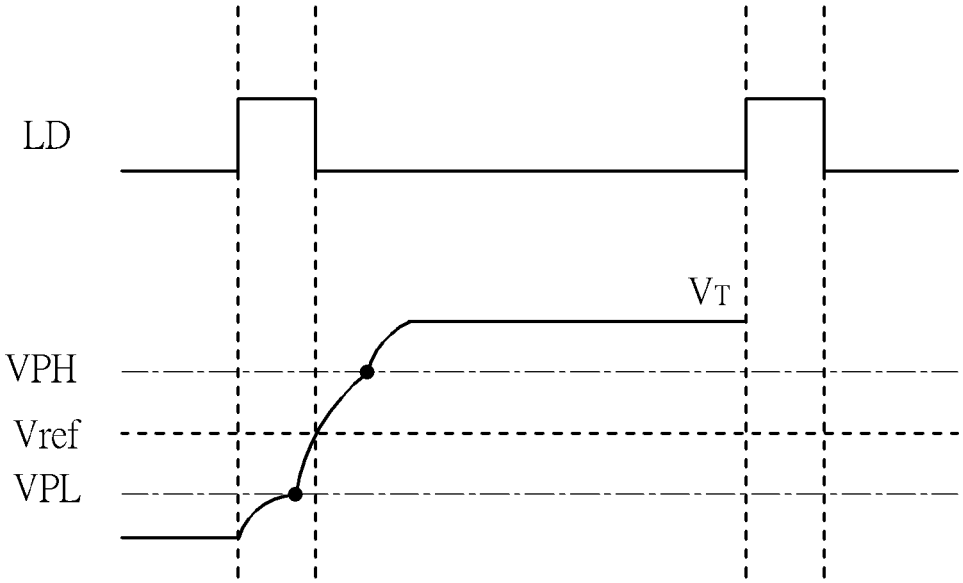

7 is opposite to which of FIG. 6. However, the embodiment in FIG. 7 has logic the same as which of FIG. 6. Therefore, the description for FIG. 11 is omitted for brevity here.

Figure 8:
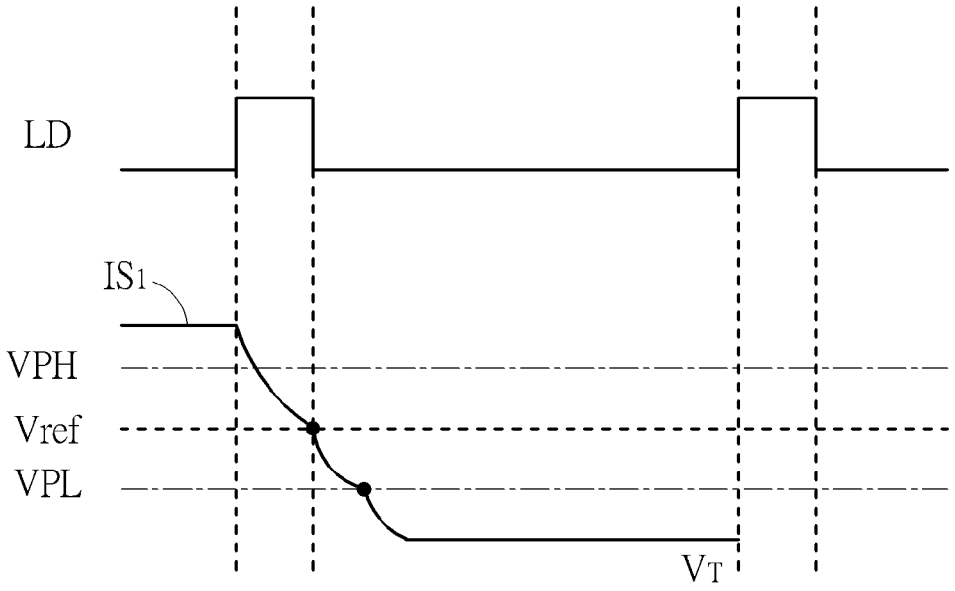
Figure 9:
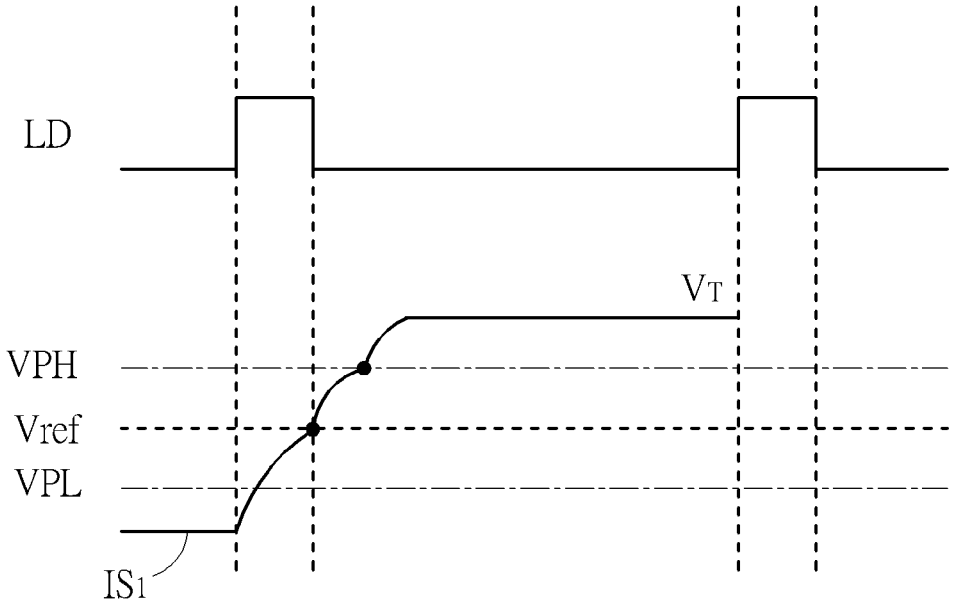

In the embodiment shown in FIG. 8, the voltage level for the first image data $IS_1$ is positive, and the absolute value thereof is larger than which of the high predetermined voltage level VPH. Also, the target voltage level VT is negative and the absolute value thereof is larger than which of the low predetermined voltage level VPL. Therefore, the voltage level that is possibly to be pre-charged to is the same as the embodiment of FIG. 4. The embodiment in FIG. 8 also utilizes the high predetermined voltage level VPH as the first predetermined voltage level. However, the embodiment of FIG. 8 pre-charges the output terminal to the reference voltage level $V_{ref}$ rather then the high predetermined voltage level VPH (i.e. pre-charges to a second predetermined voltage level different from the first predetermined voltage level) after determines that the absolute value of the voltage level for the first image data $IS_1$ is larger than which of the high predetermined voltage level VPH. After that, the output terminal is charged to the low predetermined voltage level VPL, and then charged to the target voltage level $V_T$. The phase of the embodiment in FIG. 9 is opposite to which of FIG. 8. However, the embodiment in FIG. 9 has logic the same as which of FIG. 8. Therefore, the description for FIG. 11 is omitted for brevity here.

Figure 10:
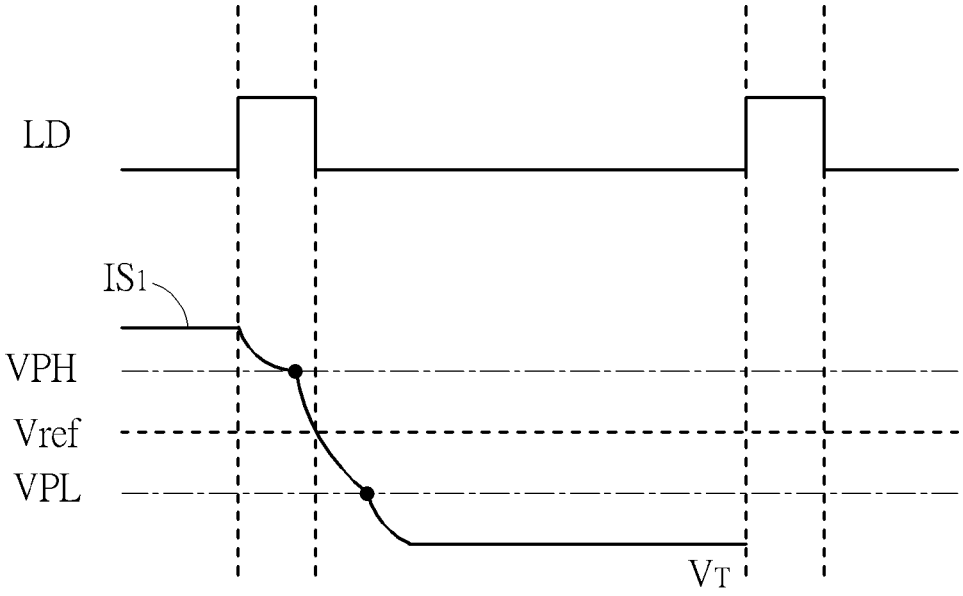

In the embodiment shown in FIG. 10, the voltage level for the first image data $IS_1$ is positive, and the absolute value thereof is larger than which of the high predetermined voltage level VPH. Also, the target voltage level VT is negative and the absolute value thereof is larger than which of the low predetermined voltage level VPL. Therefore, the voltage level that is possibly to be pre-charged to is the same as the embodiment of FIG. 4. The embodiment in FIG. 10 also utilizes the high predetermined voltage level VPH as the first predetermined voltage level. However, after determine that the absolute value of the voltage level for the first image data $IS_1$ is larger than which of the high predetermined voltage level VPH and pre-charges the output terminal to the high predetermined voltage level VPH, the embodiment in FIG. 10 only charges the output terminal to the low predetermined voltage level VPL and then directly charges the output terminal to the target voltage level $V_T$. Therefore, the embodiment in FIG. 10 does not charge to the reference voltage level $V_{ref}$. The phase of the embodiment in FIG. 11 is opposite to which of FIG. 10. However, the embodiment in FIG. 11 has logic the same as which of FIG. 10. Therefore, the description for FIG. 11 is omitted for brevity here.

Figure 12:
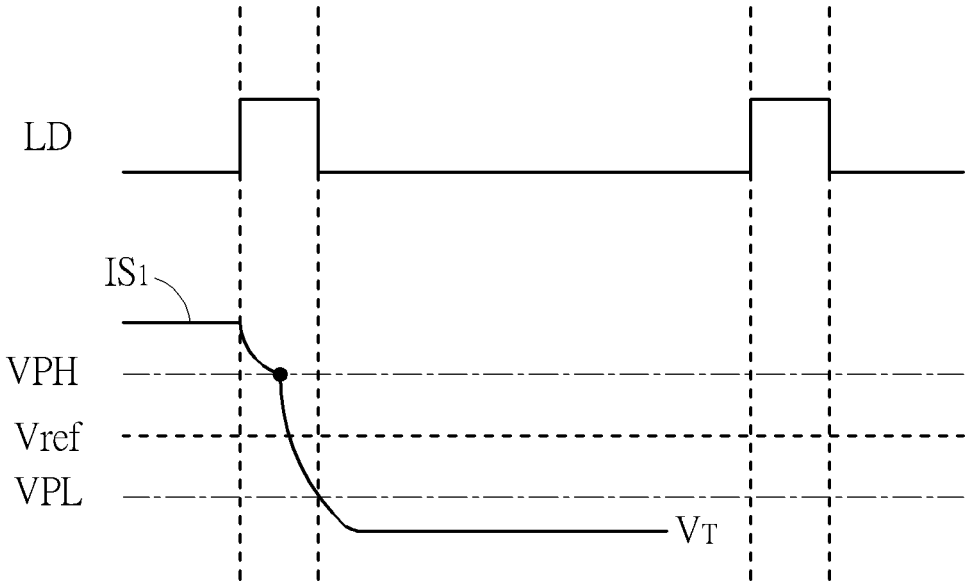

In the embodiment shown in FIG. 12, the voltage level for the first image data $IS_1$ is positive, and the absolute value thereof is larger than which of the high predetermined voltage level VPH. Also, the target voltage level $V_T$ is negative and the absolute value thereof is larger than which of the low predetermined voltage level VPL. Therefore, the voltage level that is possibly to be pre-charged to is the same as the embodiment of FIG. 4.

Figure 13:
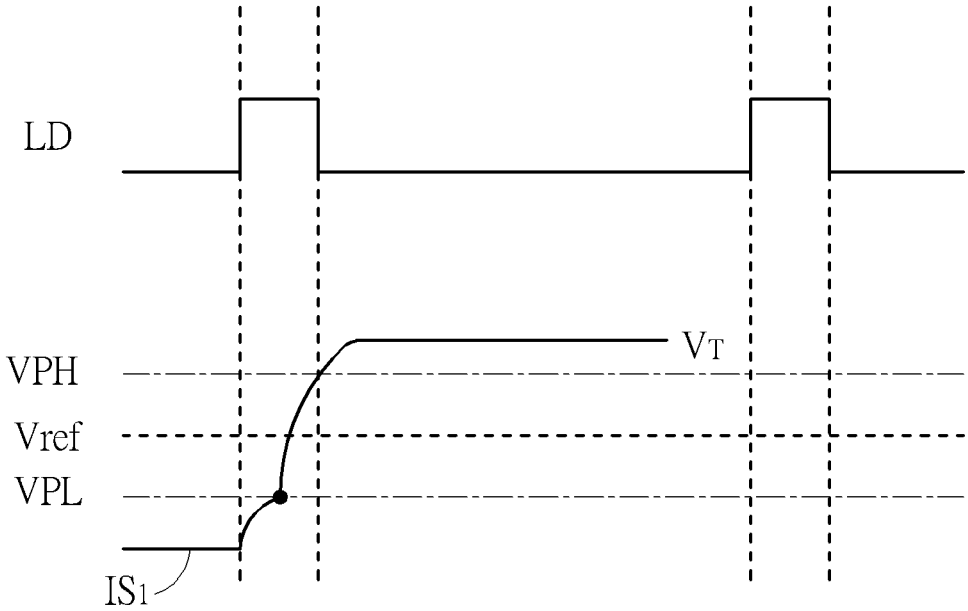

The embodiment in FIG. 12 also utilizes the high predetermined voltage level VPH as the first predetermined voltage level. However, after determine that the absolute value of the voltage level for the first image data $IS_1$ is larger than which of the high predetermined voltage level VPH and pre-charges the output terminal to the high predetermined voltage level VPH, the embodiment in FIG. 12 directly charges the output terminal to the target voltage level $V_T$. Therefore, the embodiment in FIG. 12 does not charge the output terminal to other voltage levels. The phase of the embodiment in FIG. 13 is opposite to which of FIG. 12. However, the embodiment in FIG. 13 has logic the same as which of FIG. 12. Therefore, the description for FIG. 13 is omitted for brevity here.

Figure 14:
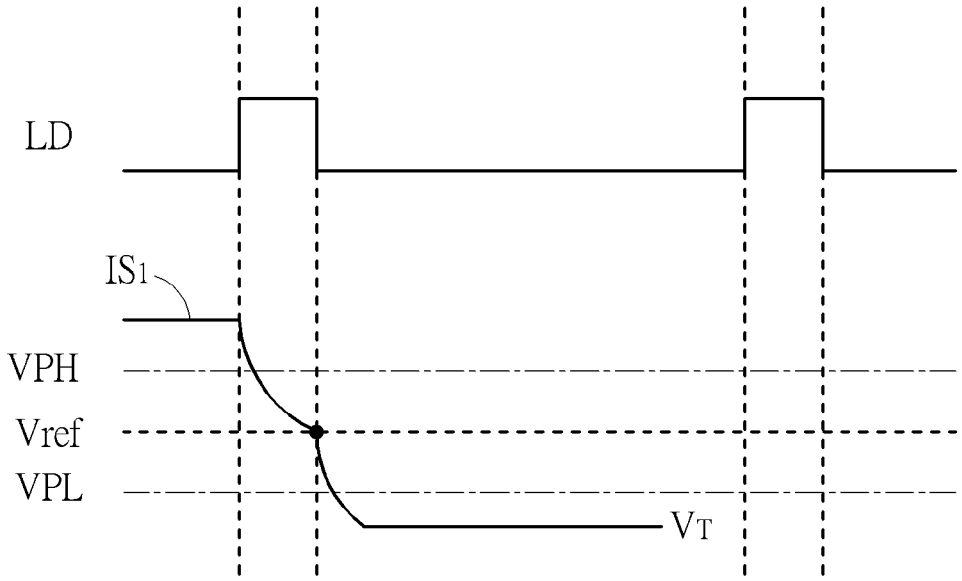
Figure 15:
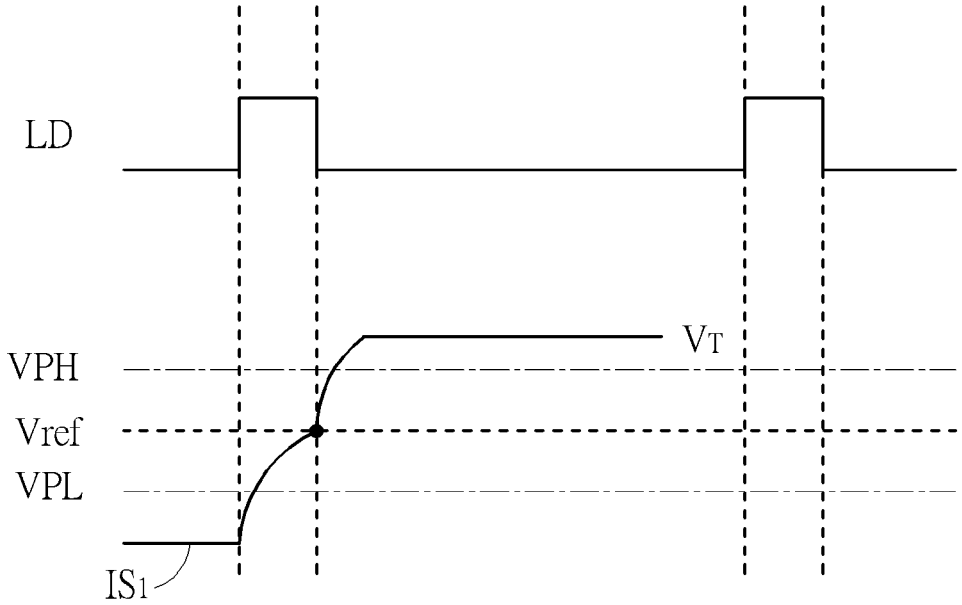

In the embodiment shown in FIG. 14, the voltage level for the first image data $IS_1$ is positive, and the absolute value thereof is larger than which of the high predetermined voltage level VPH. Also, the target voltage level $V_T$ is negative and the absolute value thereof is larger than which of the low predetermined voltage level VPL. Therefore, the voltage level that is possibly to be pre-charged to is the same as the embodiment of FIG. 4. The embodiment in FIG. 14 also utilizes the high predetermined voltage level VPH as the first predetermined voltage level. However, the embodiment of FIG. 14 pre-charges the output terminal to the reference voltage level $V_{ref}$ rather then the high predetermined voltage level VPH (i.e. pre-charges to a second predetermined voltage level different from the first predetermined voltage level) after determines that the absolute value of the voltage level for the first image data $IS_1$ is larger than which of the high predetermined voltage level VPH. After that, the output terminal is charged to the target voltage level $V_T$. The phase of the embodiment in FIG. 15 is opposite to which of FIG. 14. However, the embodiment in FIG. 15 has logic the same as which of FIG. 14. Therefore, the description for FIG. 15 is omitted for brevity here.

Figure 16:
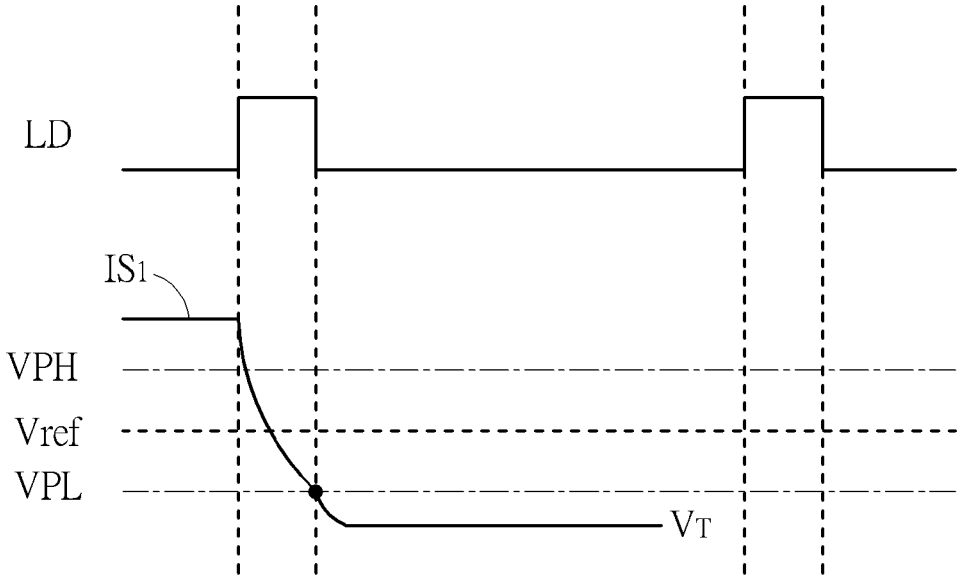
Figure 17:
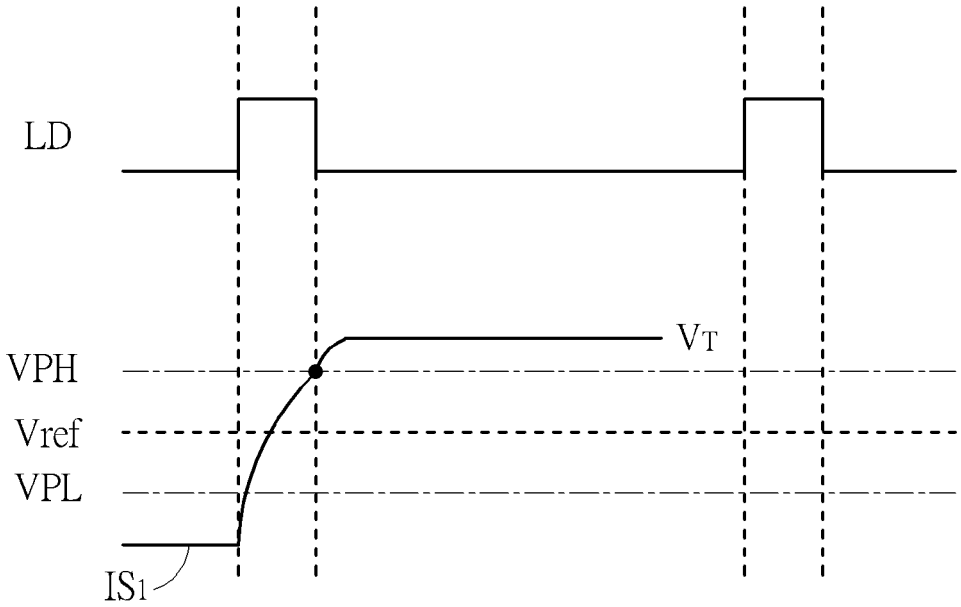

In the embodiment shown in FIG. 16, the voltage level for the first image data $IS_1$ is positive, and the absolute value thereof is larger than which of the high predetermined voltage level VPH. Also, the target voltage level $V_T$ is negative and the absolute value thereof is larger than which of the low predetermined voltage level VPL. Therefore, the voltage level that is possibly to be pre-charged to is the same as the embodiment of FIG. 4. The embodiment in FIG. 16 also utilizes the high predetermined voltage level VPH as the first predetermined voltage level. However, the embodiment of FIG. 16 pre-charges the output terminal to the low predetermined voltage level VPL rather then the high predetermined voltage level VPH (i.e. pre-charges to a second predetermined voltage level different from the first predetermined voltage level) after determines that the absolute value of the voltage level for the first image data $IS_1$ is larger than which of the high predetermined voltage level VPH. After that, the output terminal is charged to the target voltage level $V_T$. The phase of the embodiment in FIG. 17 is opposite to which of FIG. 16. However, the embodiment in FIG. 17 has logic the same as which of FIG. 16. Therefore, the description for FIG. 17 is omitted for brevity here.

Figure 18:
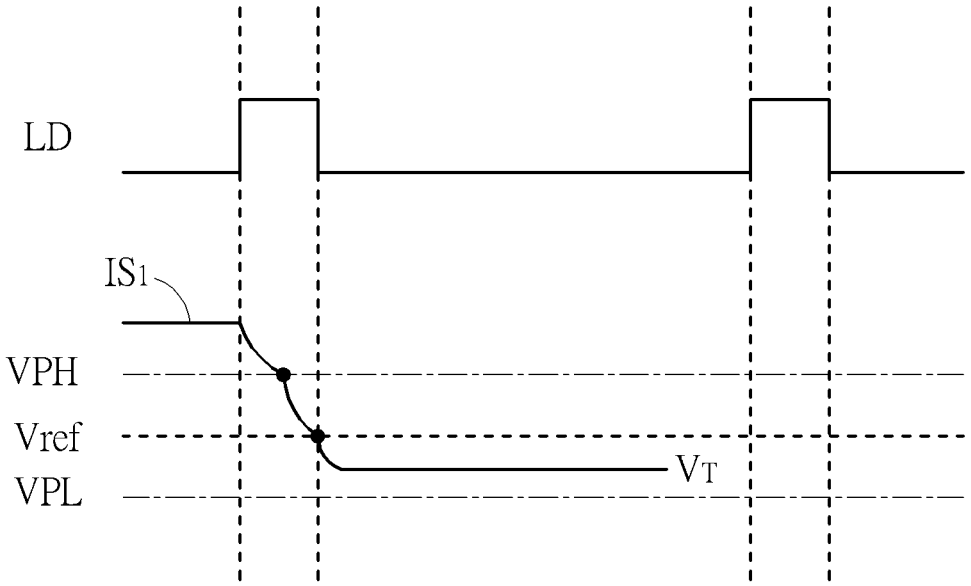
Figure 19:
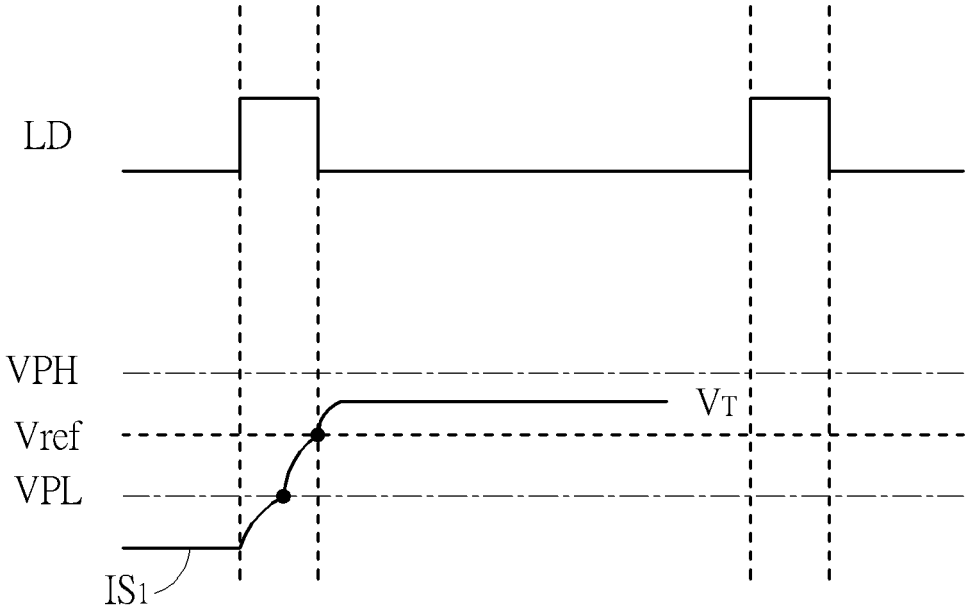

In the embodiment of FIG. 18, the voltage level for the first image data $IS_1$ is positive and the absolute value thereof is larger than which of the high predetermined voltage level. However, the target voltage level $V_T$ in FIG. 18 is different from which of the above-mentioned embodiment. The target voltage level $V_T$ of FIG. 18 is positive and the absolute value thereof is between absolute values of the low predetermined voltage level VPL and the reference voltage level $V_{ref}$. Therefore, the voltage level that can be pre-charged to can be the high predetermined voltage level VPH or the reference voltage level $V_{ref}$, which are both between the voltage levels of the first image data $IS_1$ and the target voltage level $V_T$. The embodiment in FIG. 18 also utilizes the high predetermined voltage level VPH as the first predetermined voltage level. In this embodiment, the output terminal is sequentially pre-charged to the high predetermined voltage VPH, charged to the reference voltage level $V_{ref}$, and then charged to the target voltage level $V_T$, after determines that the absolute value of the voltage level for the first image data $IS_1$ is larger than which of the high predetermined voltage level VPH. The phase of the embodiment in FIG. 19 is opposite to which of FIG. 18. However, the embodiment in FIG. 19 has logic the same as which of FIG. 18. Therefore, the description for FIG. 19 is omitted for brevity here.

Figure 20:
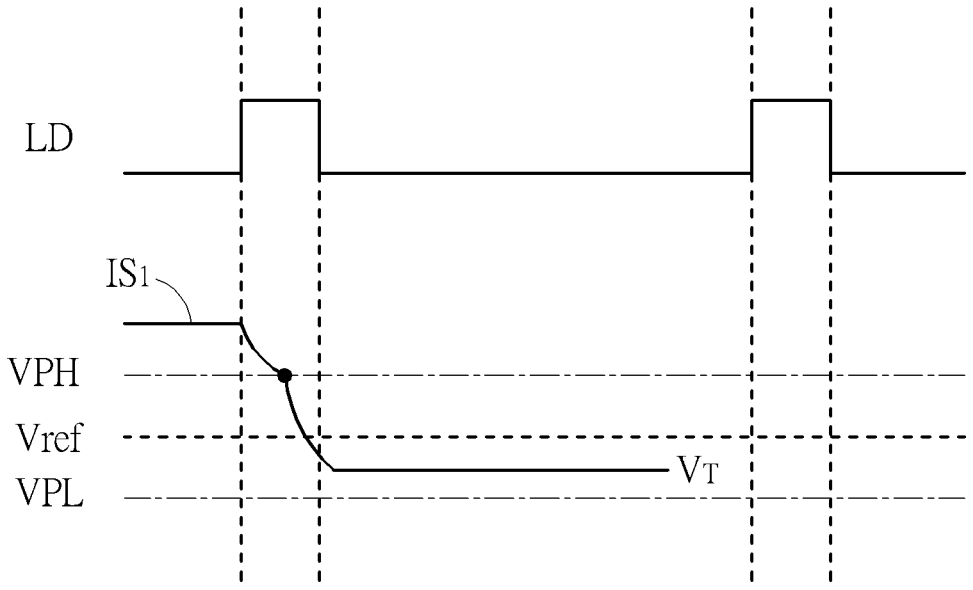
Figure 21:
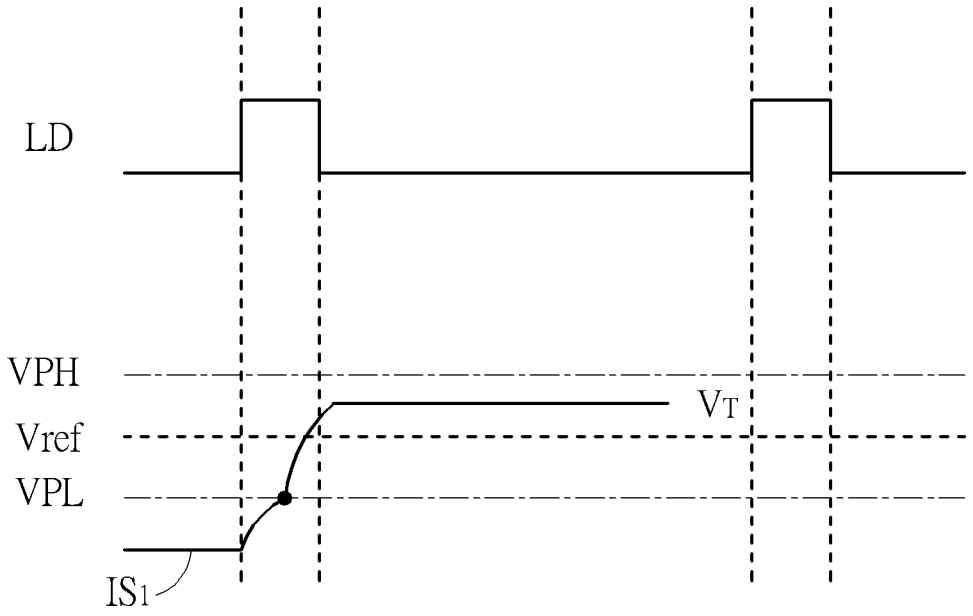

In the embodiment of FIG. 20, the voltage level for the first image data $IS_1$ is positive. The target voltage level $V_T$ in FIG. 20 is the same which in FIG. 18. That is, the target voltage level $V_T$ is positive and the absolute value thereof is between absolute values of the low predetermined voltage level VPL and the reference voltage level $V_{ref}$. Therefore, the voltage level that can be pre-charged in FIG. 20 is the same as which of FIG. 18. The embodiment in FIG. 20 also utilizes the high predetermined voltage level VPH as the first predetermined voltage level, and the target voltage level $V_T$ is also between the low predetermined voltage level VPL and the reference voltage level $V_{ref}$. In this embodiment, the output terminal is pre-charged to the high predetermined voltage VPH and then directly charged to the target voltage level $V_T$, after determines that the absolute value of the voltage level for the first image data $IS_1$ is larger than which of the high predetermined voltage level VPH. The phase of the embodiment in FIG. 21 is opposite to which of FIG. 20. However, the embodiment in FIG. 21 has logic the same as which of FIG. 20. Therefore, the description for FIG. 21 is omitted for brevity here.

Figure 22:
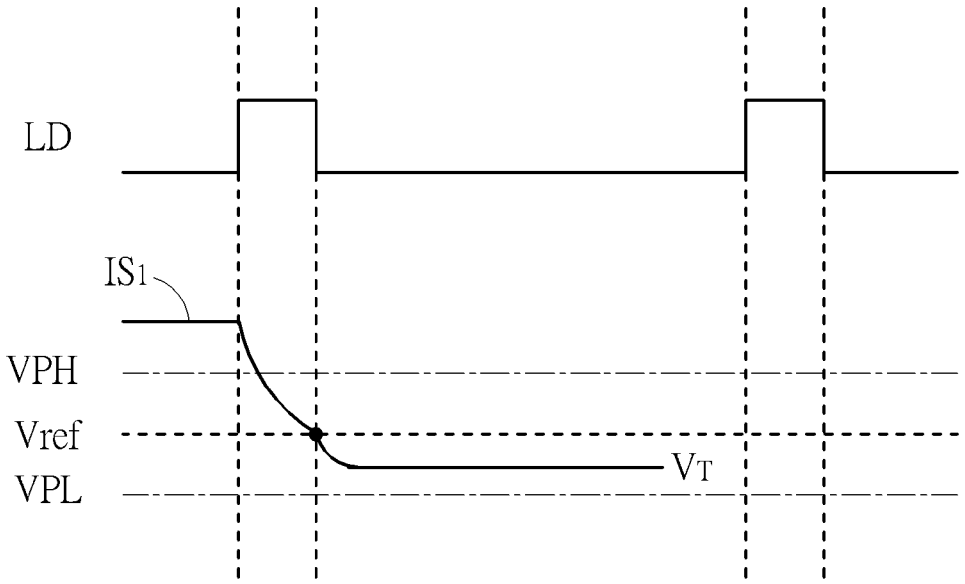
Figure 23:
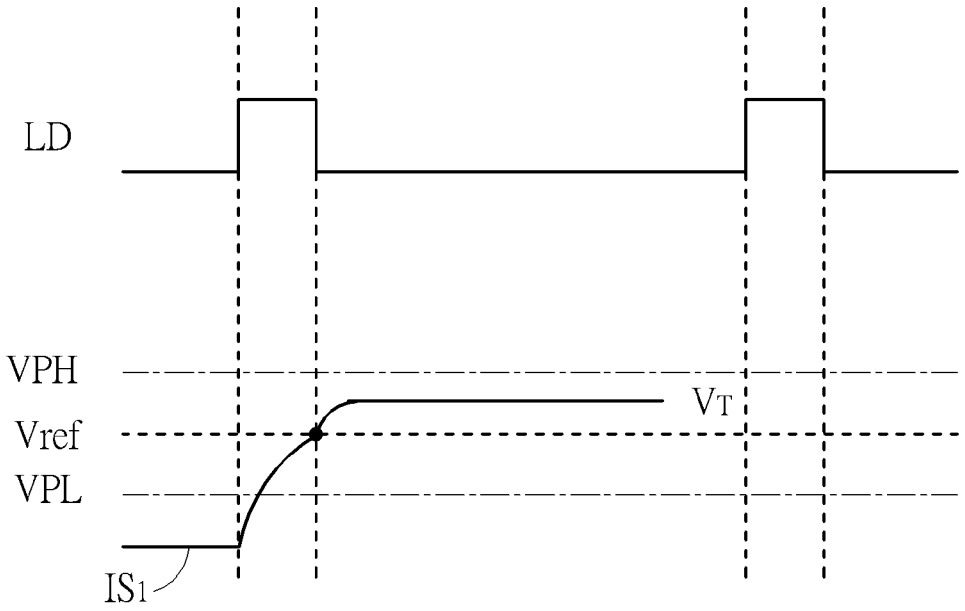

In the embodiment of FIG. 22, the voltage level for the first image data $IS_1$ is positive. The target voltage level $V_T$ in FIG. 22 is the same which in FIG. 18. That is, the target voltage level $V_T$ is positive and the absolute value thereof is between absolute values of the low predetermined voltage level VPL and the reference voltage level $V_{ref}$. Therefore, the voltage level that can be pre-charged in FIG. 22 is the same as which of FIG. 18. The embodiment in FIG. 22 also utilizes the high predetermined voltage level VPH as the first predetermined voltage level. However, this embodiment pre-charges the output terminal to the reference voltage level $V_{ref}$ rather than the high predetermined voltage VPH, and then directly charges to the target voltage level $V_T$, after determines that the absolute value of the voltage level for the first image data $IS_1$ is larger than which of the high predetermined voltage level VPH. Also, the target voltage level $V_T$ is between the low predetermined voltage level VPL and the reference voltage level $V_{ref}$. The phase of the embodiment in FIG. 23 is opposite to which of FIG. 22. However, the embodiment in FIG. 23 has logic the same as which of FIG. 22. Therefore, the description for FIG. 23 is omitted for brevity here.

Figure 24:
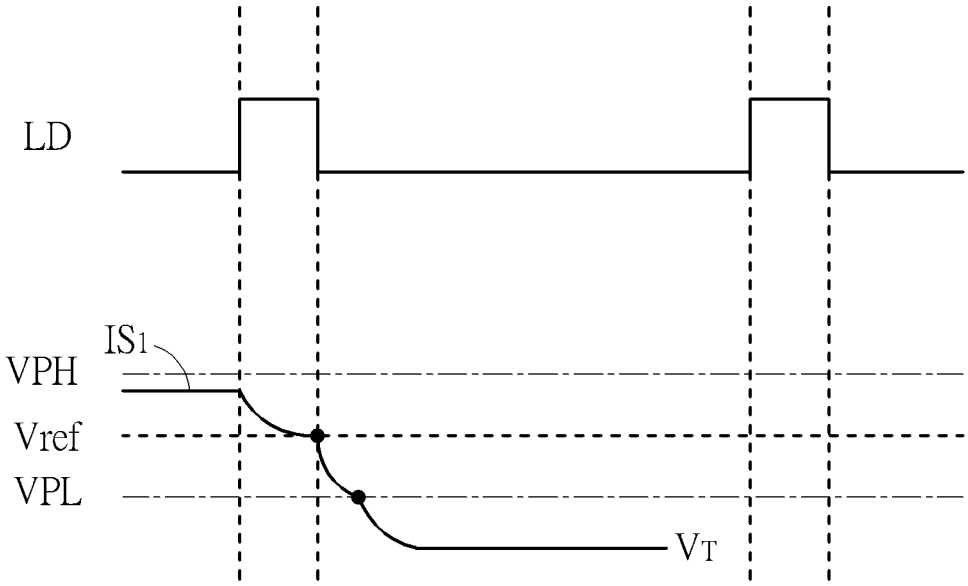
Figure 25:
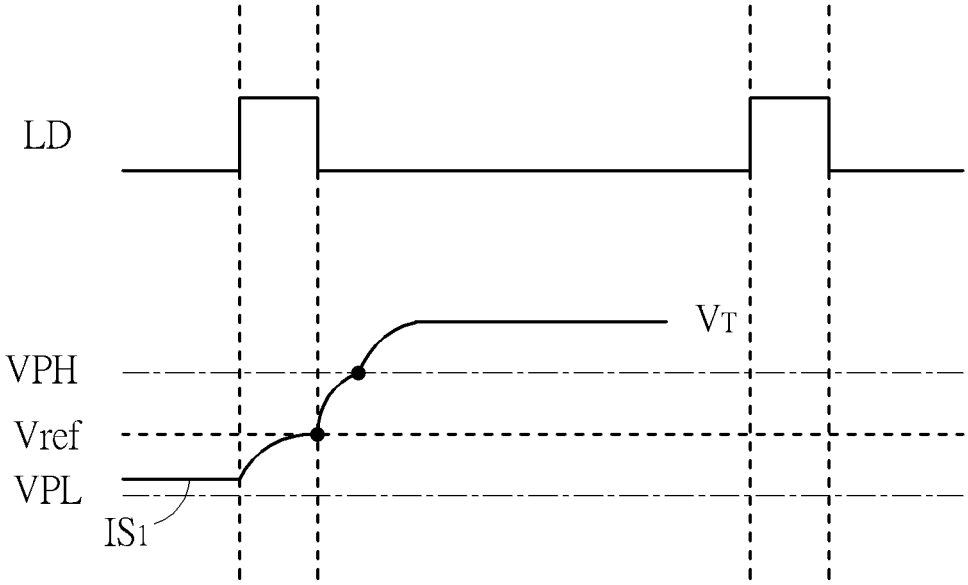

In the embodiment of FIG. 24, the voltage level for the first image data $IS_1$ is positive and the absolute value thereof is between absolute values of the high predetermined voltage level VPH and the reference voltage level $V_{ref}$. Also, the target voltage level $V_T$ is negative and the absolute value thereof is larger than which of the low predetermined voltage level VPL. Therefore, the voltage level that can be pre-charged to can be the low predetermined voltage level VPH or the reference voltage level $V_{ref}$, which are both between the voltage levels of the first image data $IS_1$ and the target voltage level $V_T$. The embodiment in FIG. 24 utilizes the reference voltage level $V_{ref}$ as the first predetermined voltage level. In this embodiment, the output terminal is sequentially pre-charged to the reference voltage level $V_{ref}$, pre-charged to the low predetermined voltage level and then charged to the target voltage level $V_T$, after determines that the absolute value of the voltage level for the first image data $IS_1$ is larger than the reference voltage level $V_{ref}$. The target voltage level $V_T$ is larger than which of the low predetermined voltage level VPL. The phase of the embodiment in FIG. 25 is opposite to which of FIG. 24. However, the embodiment in FIG. 25 has logic the same as which of FIG. 24. Therefore, the description for FIG. 25 is omitted for brevity here.

Figure 26:
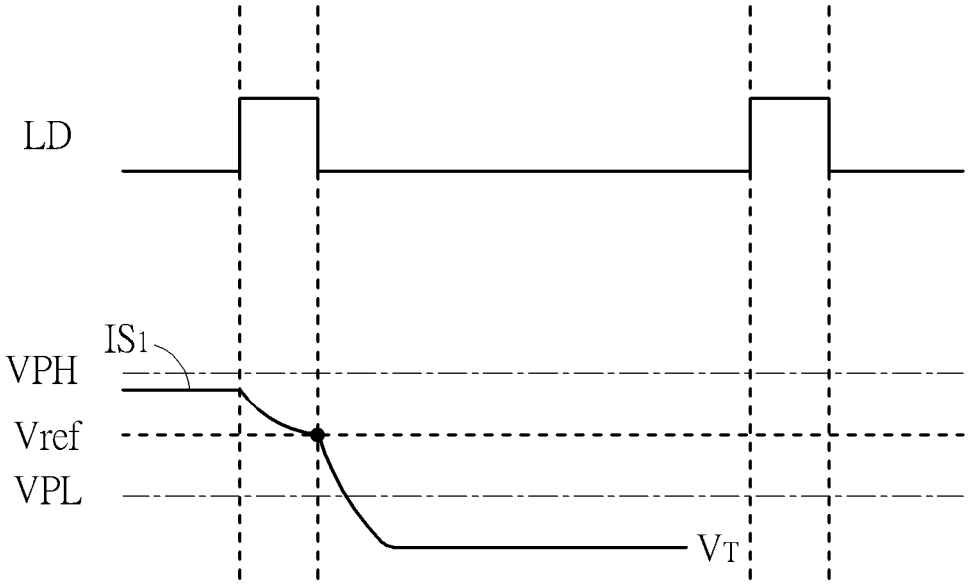
Figure 27:
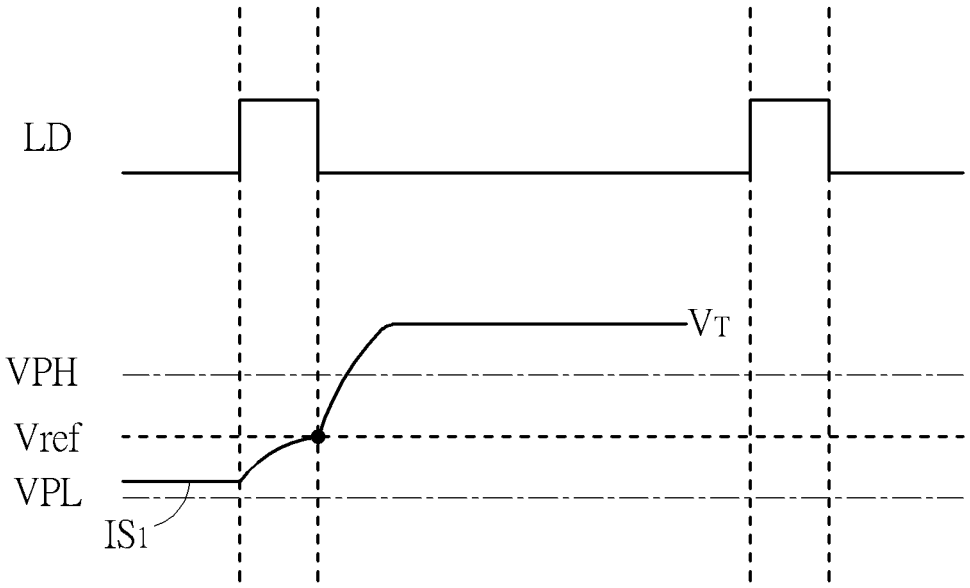

In the embodiment of FIG. 26, the voltage level for the first image data $IS_1$ is positive and the absolute value thereof is between absolute values of the high predetermined voltage level VPH and the reference voltage level $V_{ref}$. Also, the target voltage level $V_T$ is negative and the absolute value thereof is larger than which of the low predetermined voltage level VPL. Therefore, the voltage level that can be pre-charged to is the same as which of the embodiment shown in FIG. 24. The embodiment in FIG. 26 utilizes the reference voltage level $V_{ref}$ as the first predetermined voltage level. In this embodiment, the output terminal is pre-charged to the reference voltage level $V_{ref}$ and then charged to the target voltage level $V_T$, after determines that the absolute value of the voltage level for the first image data $IS_1$ is larger than the reference voltage level $V_{ref}$. The phase of the embodiment in FIG. 27 is opposite to which of FIG. 26. However, the embodiment in FIG. 27 has logic the same as which of FIG. 26. Therefore, the description for FIG. 27 is omitted for brevity here.

Figure 28:
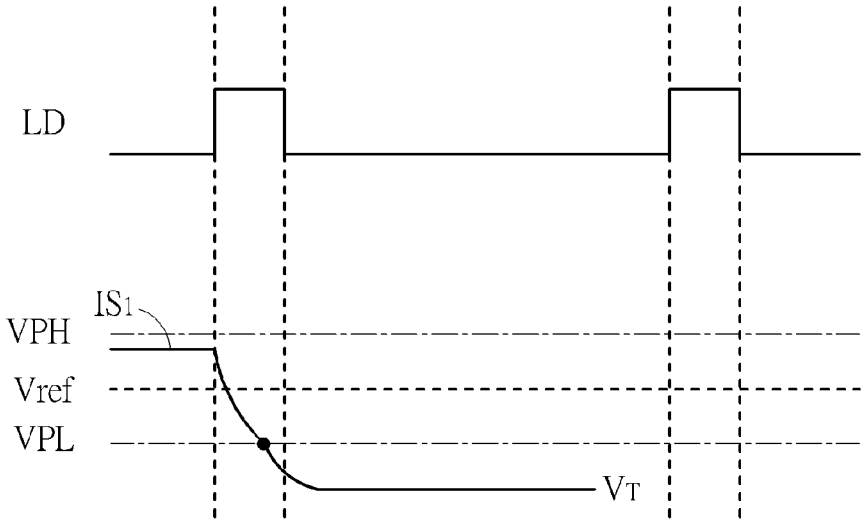
Figure 29:
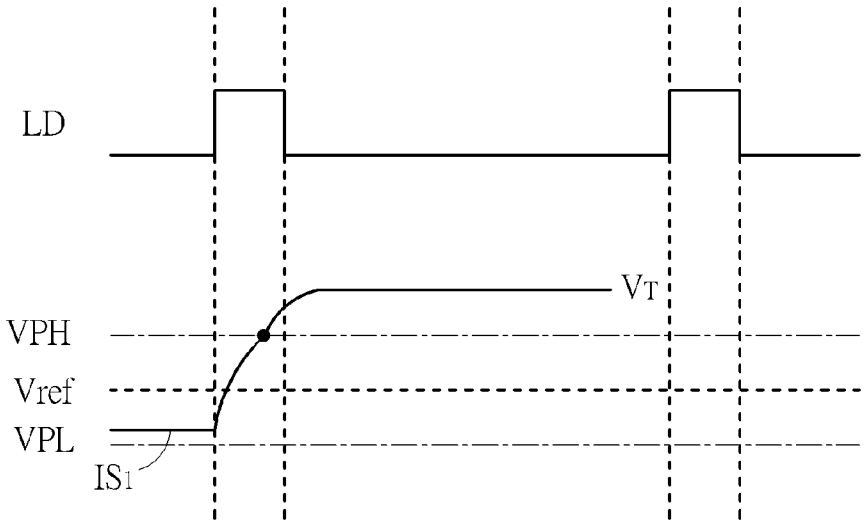

In the embodiment of FIG. 28, the voltage level for the first image data $IS_1$ is positive and the absolute value thereof is between absolute values of the high predetermined voltage level VPH and the reference voltage level $V_{ref}$. Also, the target voltage level $V_T$ is negative and the absolute value thereof is larger than which of the low predetermined voltage level VPL. Therefore, the voltage level that can be pre-charged to is the same as which of the embodiment shown in FIG. 24. The embodiment in FIG. 26 utilizes the reference voltage level $V_{ref}$ as the first predetermined voltage level. In this embodiment, the output terminal is pre-charged to the low predetermined voltage level VPL rather than the reference voltage level $V_{ref}$ (i.e. a second predetermined voltage level different from the first predetermined voltage level) and then charged to the target voltage level $V_T$, after determines that the absolute value of the voltage level for the first image data $IS_1$ is larger than the reference voltage level $V_{ref}$. The phase of the embodiment in FIG. 29 is opposite to which of FIG. 28. However, the embodiment in FIG. 29 has logic the same as which of FIG. 28. Therefore, the description for FIG. 27 is omitted for brevity here.

Figure 30:
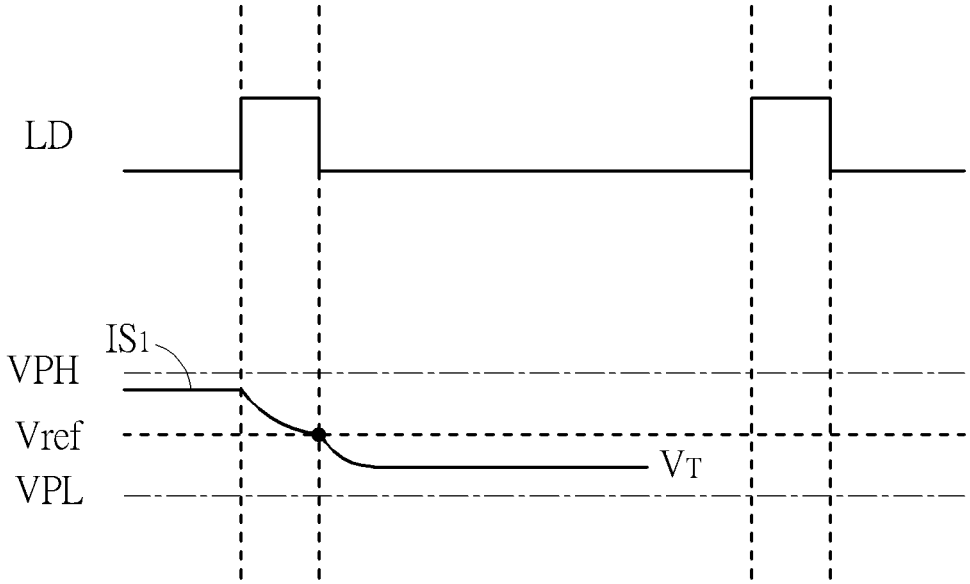
Figure 31:
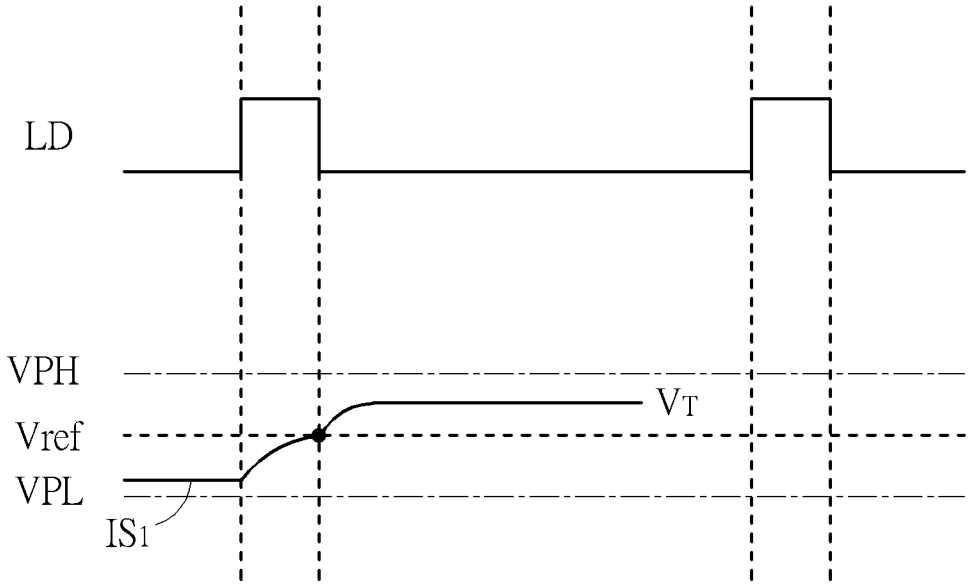

In the embodiment of FIG. 30, the voltage level for the first image data $IS_1$ is positive and the absolute value thereof is between absolute values of the high predetermined voltage level VPH and the reference voltage level $V_{ref}$. Also, the target voltage level $V_T$ is negative and the absolute value thereof is between absolute values of the low predetermined voltage level VPL and the reference voltage level $V_{ref}$. Therefore, the voltage level that can be pre-charged to is the reference voltage level $V_{ref}$, which is between the voltage levels of the first image data $IS_1$ and the target voltage level $V_T$. The embodiment in FIG. 30 utilizes the reference voltage level $V_{ref}$ as the first predetermined voltage level. In this embodiment, the output terminal is sequentially pre-charged to the reference voltage level $V_{ref}$ and then charged to the target voltage level $V_T$, after determines that the absolute value of the voltage level for the first image data $IS_1$ is larger than the reference voltage level $V_{ref}$. The phase of the embodiment in FIG. 31 is opposite to which of FIG. 30. However, the embodiment in FIG. 31 has logic the same as which of FIG. 30. Therefore, the description for FIG. 31 is omitted for brevity here.

FIG. 32-FIG. 37 are schematic diagrams illustrating the operation for the single channel source driver according to one embodiment of the present invention when the single channel source driver does not perform polarity inversing. In the following embodiment, the high predetermined voltage level VPH is positive and the low predetermined voltage level VPL is negative. Also the reference voltage level $V_{ref}$ is between VPH and VPL, which can be 0 or other values. If the LCD does not perform polarity inversing, data for two adjacent pixels is all negative or positive. In such case, the detection controlling circuit charges the output terminal of the first image data providing apparatus 301 to the high predetermined voltage level VPH, low predetermined voltage level VPL or the reference voltage level $V_{ref}$, according to a relation between absolute values for the voltage level of the image data for two adjacent pixel line, and absolute values of the high predetermined voltage level VPH/low predetermined voltage level VPL. In the embodiments shown in FIGS. 32-37, the output terminal is determined to charged or pre-charged to a voltage level according to the voltage levels of the image data for a previous pixel line and a current pixel line.

Figure 32:
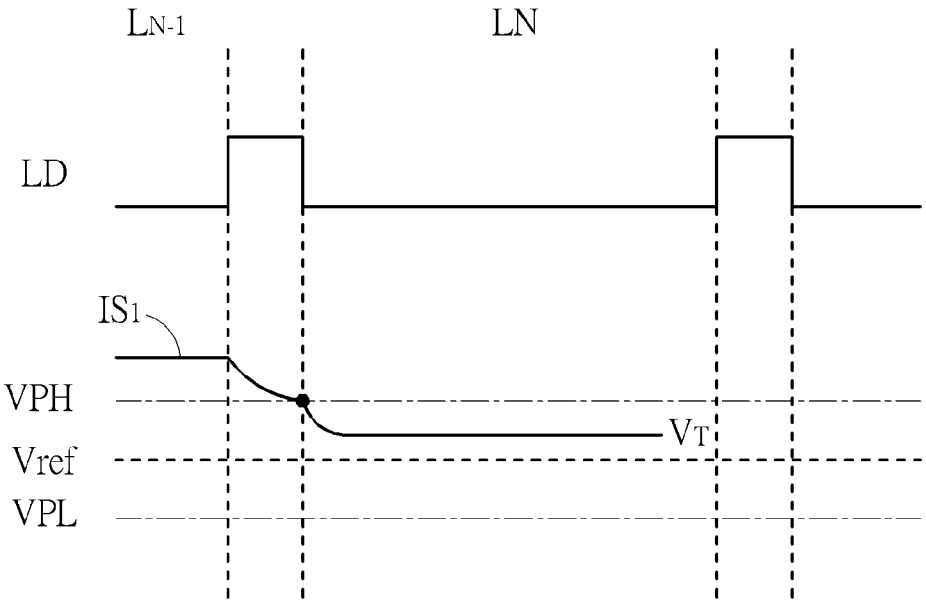
FIG. 32-FIG. 37 are schematic diagrams illustrating the operation for the single channel source driver according to one embodiment of the present invention when the single channel source driver does not perform polarity inversing.
Figure 33:
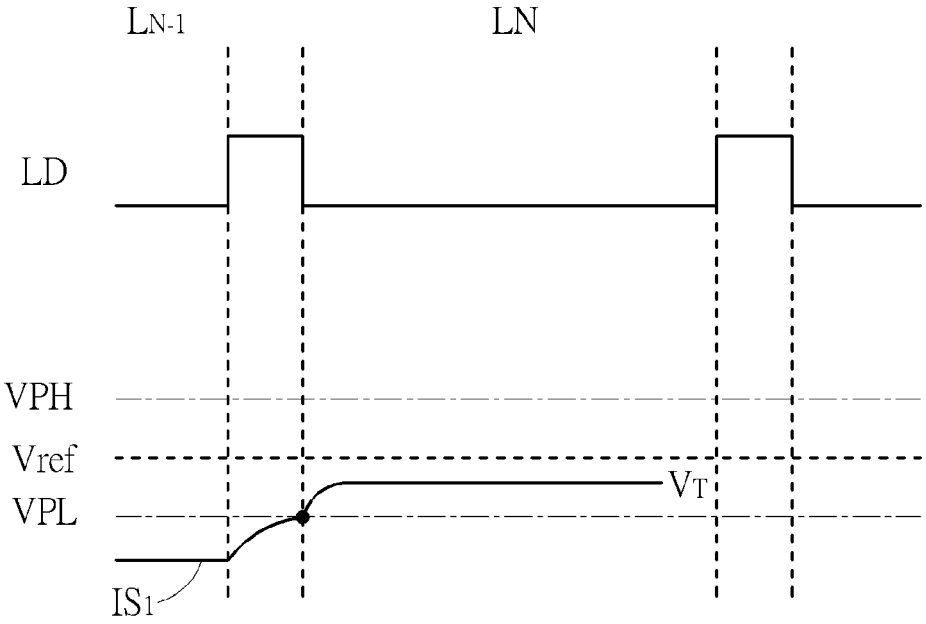

As shown in FIG. 32, if an absolute value for a voltage level of image data of a previous pixel line ($L_{N-1}$) is larger than which of the high predetermined voltage level VPH (the first predetermined voltage level), and an absolute value for a voltage level of the image data of a current pixel line ($L_N$) is smaller than which of the high predetermined voltage level VPH, the detection controlling circuit 307 pre-charges the output terminal of the first image data providing apparatus 301 to the high predetermined voltage level VPH and then charges to the target voltage level $V_T$ (i.e. the image pixel line voltage level for the current pixel line). The phase of the embodiment in FIG. 33 is opposite to which of FIG. 32. However, the embodiment in FIG. 33 has logic the same as which of FIG. 32. Therefore, the description for FIG. 33 is omitted for brevity here.

Figure 34:
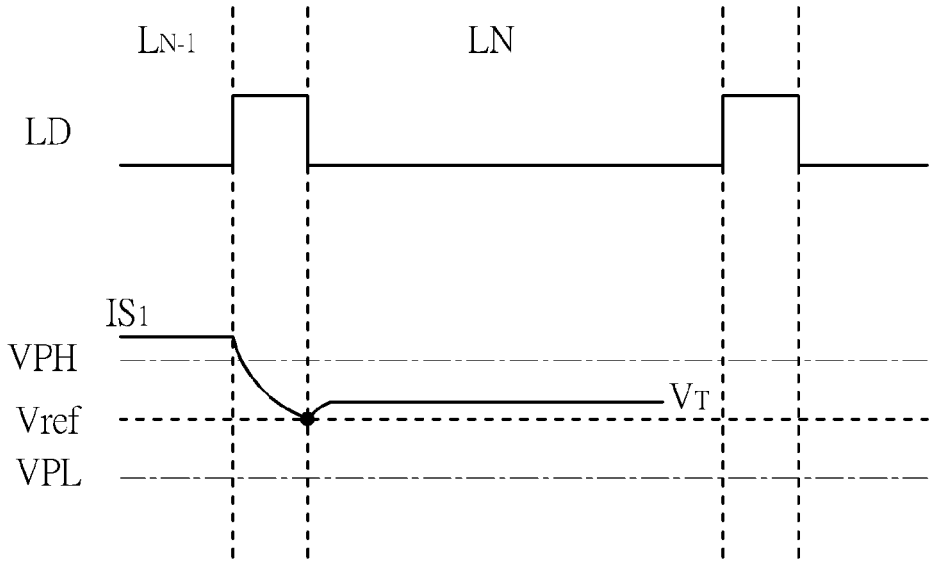
Figure 35:
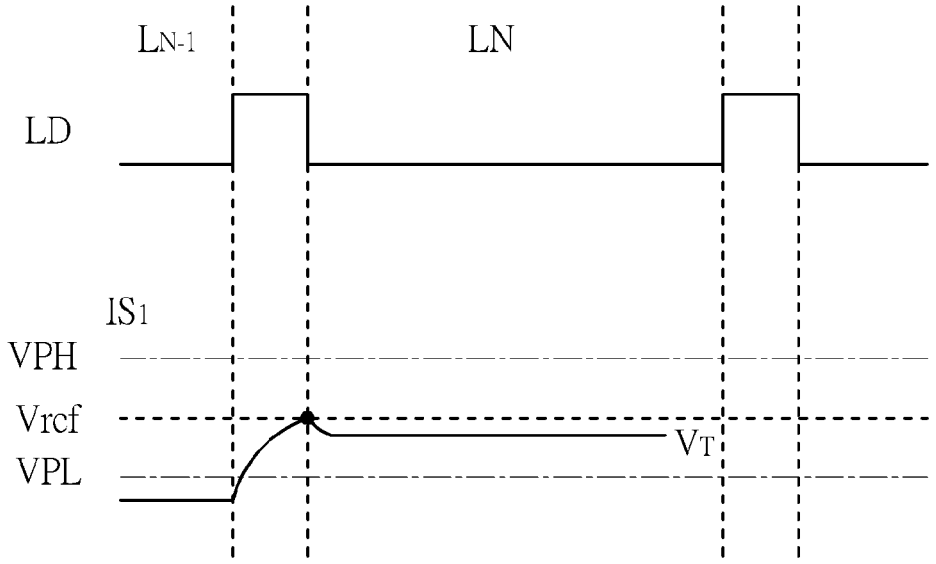

In the embodiment shown in FIG. 34, an absolute value for a voltage level of image data of a previous pixel line is larger than which of the high predetermined voltage level VPH, and an absolute value for a voltage level of the image data of a current pixel line is smaller than which of the high predetermined voltage level VPH. There is some difference between the embodiments of FIG. 32 and FIG. 34, however. In the embodiment of FIG. 34, the absolute value for the voltage level of the image data of the current pixel line is closer to the reference voltage level $V_{ref}$ rather than the high predetermined voltage level VPH. Therefore, the detection controlling circuit 307 pre-charges the output terminal of the first image data providing apparatus 301 to the reference voltage level $V_{ref}$ rather than the high predetermined voltage level VPH and then charges to the target voltage level $V_T$ (i.e. the image pixel line voltage level for the current pixel line). The phase of the embodiment in FIG. 35 is opposite to which of FIG. 34. However, the embodiment in FIG. 35 has logic the same as which of FIG. 34.

Figure 36:
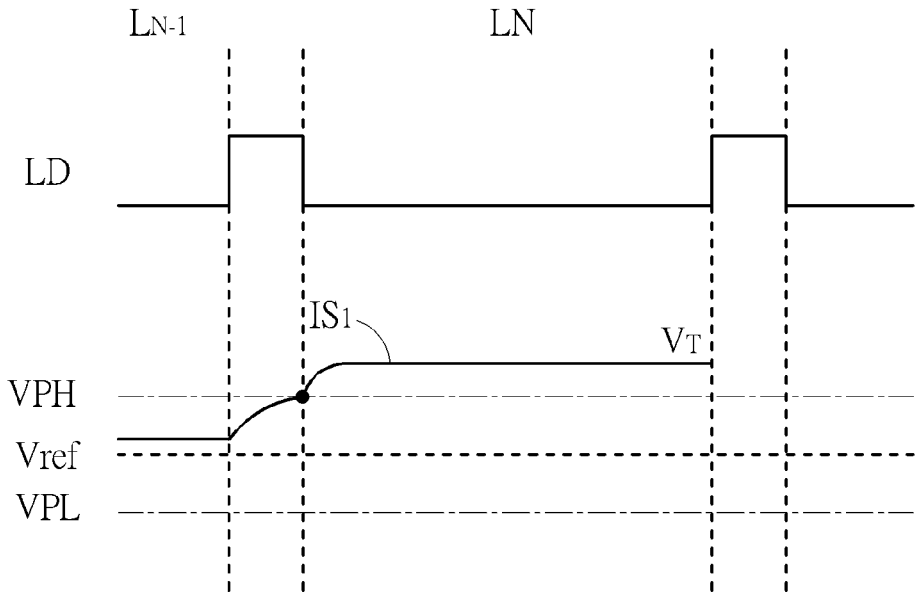
Figure 37:
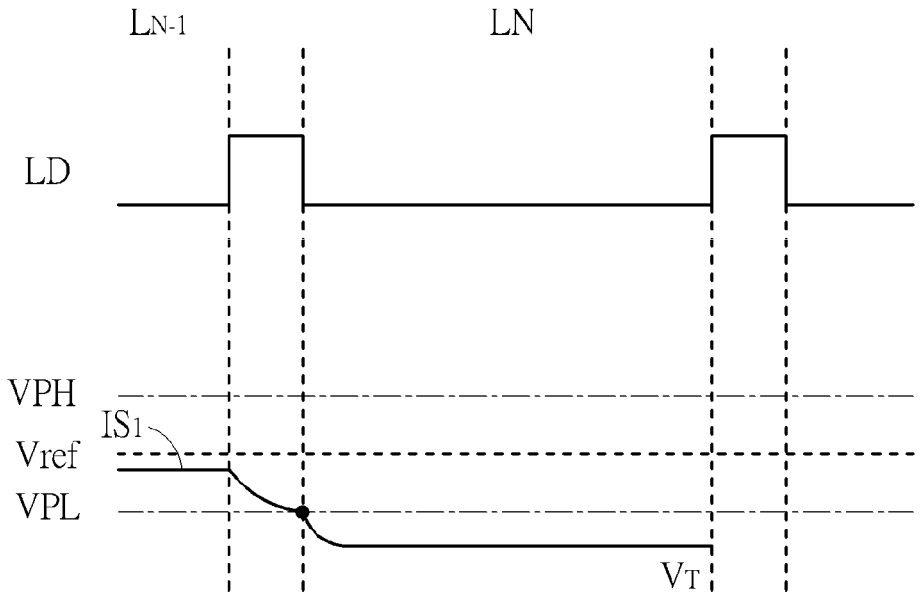

In the embodiment shown in FIG. 36, if an absolute value for a voltage level of image data of a previous pixel line ($L_{N-1}$) is smaller than which of the high predetermined voltage level VPH (the first predetermined voltage level), and an absolute value for a voltage level of the image data of a current pixel line ($L_N$) is larger than which of the high predetermined voltage level VPH, the detection controlling circuit 307 pre-charges the output terminal of the first image data providing apparatus 301 to the high predetermined voltage level VPH and then charges to the target voltage level $V_T$ (i.e. the image pixel line voltage level for the current pixel line). The phase of the embodiment in FIG. 37 is opposite to which of FIG. 36. However, the embodiment in FIG. 37 has logic the same as which of FIG. 36.

Please note that the embodiment shown in FIG. 4 to FIG. 37 further comprise a data reading signal LD, which indicates that the first image data providing apparatus 301 will output data. In one embodiment, the pre-charging operation is performed when the data reading signal LD has a high logic value, and the image data providing apparatus 301 outputs the image data when the data reading signal LD has a low logic value. It does not mean to limit, however. The pre-charge operation can be performed at other timings. For example, the falling edge of the data reading signal LD.

Figure 38:
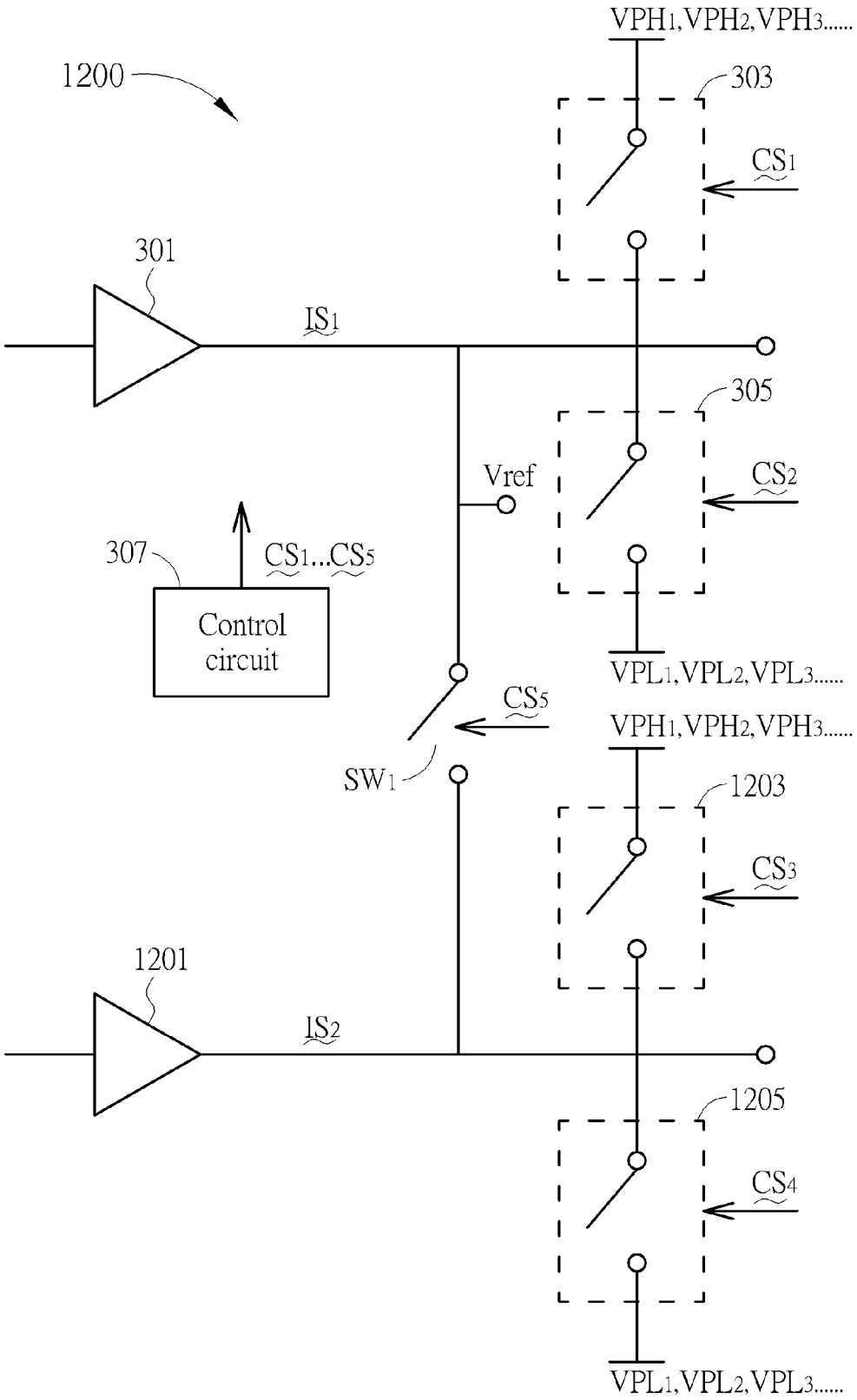
FIG. 38 is a circuit diagram illustrating a source driver according to another embodiment of the present invention.

Please refer to FIG. 3 again. In FIG. 3, the detection controlling circuit 307 only controls the image data transmitting for one channel. However, the detection controlling circuit 307 can control image data transmitting for two or more channels. As shown in FIG. 38, besides the first image data providing apparatus 301, the predetermined voltage level providing apparatuses 303, 305, the detection controlling circuit 307 can further control another channel, which comprises the second image data providing apparatus 1201, the predetermined voltage level providing apparatuses 1203, 1205. The two channels respectively transmit the first image data $IS_1$ and the second image data $IS_2$. The pre-charge mechanism of multi-channels is the same as which of the single channel. Accordingly, the detection controlling circuit 307 can control the second image data providing apparatus 1201, the predetermined voltage level providing apparatuses 1203, 1205 to perform the pre-charging operation shown in FIG. 4-FIG. 37. In such embodiment, the detection controlling circuit 307 generate control signals to control the switch device $SW_1$, and switches devices in the predetermined voltage level providing apparatuses 303, 305, 1203, 1205.

Figure 39:
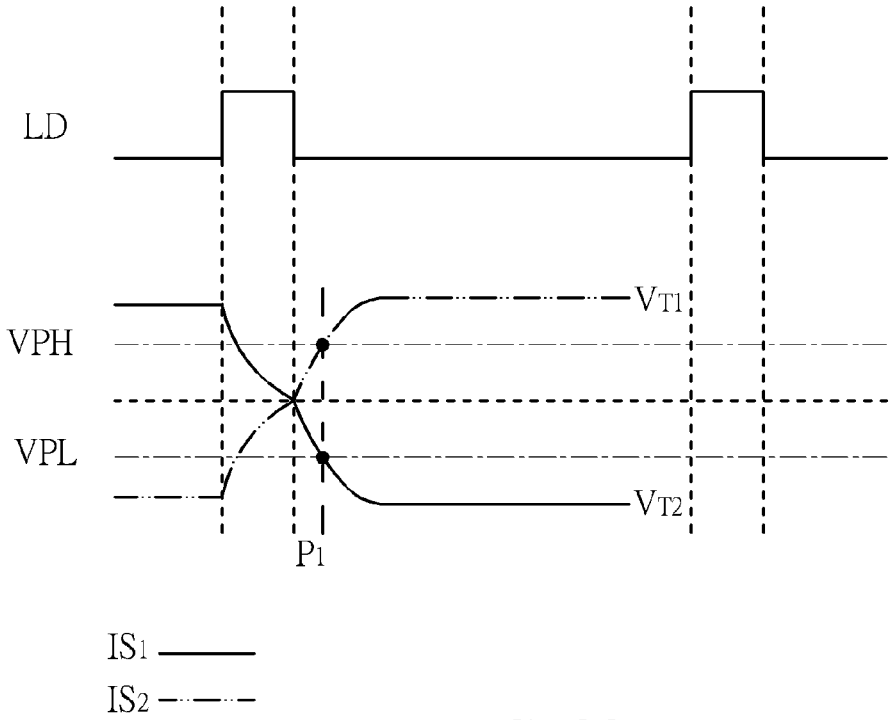
FIG. 39 is a schematic diagram illustrating the operation for the two channel source driver according to one embodiment of the present invention when the two channel source driver performs polarity inversing.

The operation for the two channel source driver will be described as below. Please note that the following embodiments only correspond to some of the above-mentioned embodiments, since there are plenty of embodiments for the single channel source driver. However, it does not mean the two channel source driver according to the present invention is limited to following embodiments. The two channel source driver according to the present invention can be any combination for above-mentioned embodiments. FIG. 39 is a schematic diagram illustrating the operation for the two channel source driver according to one embodiment of the present invention when the two channel source driver performs polarity inversing, which is a combination for the embodiments shown in FIG. 8, FIG. 9. As shown in FIG. 39, the first image data $IS_1$ transits from positive to negative, and an absolute value of the voltage level for the first image data $IS_1$ is larger than which of the high predetermined voltage level VPH, thus the output terminal of the source driver is pre-charged to the high predetermined voltage level VPH. The second image data $IS_2$ transits from negative to positive, and an absolute value of the voltage level for the second image data $IS_2$ is larger than which of the low predetermined voltage level VPL, thus the output terminal of the source driver is pre-charged to the low predetermined voltage level VPL.

In above-mentioned embodiments, the pre-charge operation is performed when the data reading signal LD has a high logic value. In the embodiment shown in FIG. 9, the output terminals of the first image data providing apparatus 301 and the second image data providing apparatus 1201 are further shorted (i.e. the switch $SW_1$ is conductive), such that the charges can be shared and the voltage level of the output terminals is close to a voltage level between the high predetermined voltage level VPH and the low predetermined voltage level VPL (ex. the reference voltage level but not limited). After that, the pre-charge operation is performed in the following time period P1, which pre-charges the output terminals to the high predetermined voltage level VPH or the low predetermined voltage level VPL. However, the pre-charge operation can be performed without performing the charge sharing operation. The charge sharing operation can be triggered by various conditions. One of the conditions is if it is detected that two adjacent pixels lines must perform a polarity inversing operation, the charge sharing operation is performed after the data of the first pixel is outputted. The signal level transits from positive to negative or negative to positive, if the polarity is inversed. Therefore, if a charge-sharing operation is performed, the voltage level at the output terminal of the image data providing apparatus is varied to a voltage close to the reference voltage $V_{ref}$, such that the output terminal is not needed to be charged from a voltage level of a polarity to a voltage level of another polarity. Also, after the pre-charge operation is performed, output terminals of the first image data providing apparatus 301 and the second image data providing apparatus 1201 are respectively charged to the target voltages $V_{T1}$ and $V_{T2}$. In another embodiment, the first image data $IS_1$ transits from negative to positive and the second image data $IS_2$ transits from positive to negative, therefore the curves thereof will be swapped. The detail for such example can be acquired according to the embodiment of FIG. 39, thus it is omitted for brevity here.

Figure 40:
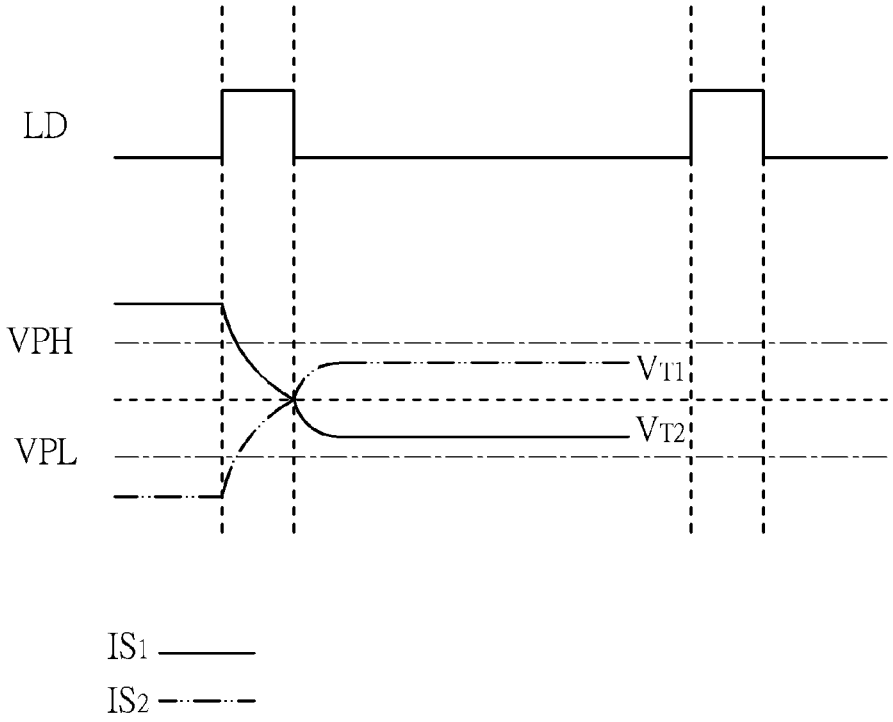
FIG. 40 is a schematic diagram illustrating the operation for the two channel source driver according to one embodiment of the present invention when the two channel source driver does not perform polarity inversing but performs a charge sharing operation.

The embodiment shown in FIG. 40 comprises the charge sharing operation shown in FIG. 39, but the target voltage levels $V_{T1}$, $V_{T2}$ are different for these two embodiments. Also, the polarities of the embodiments shown in FIG. 40 are not inversed. Take the first image data $IS_1$ for example, the absolute value of the target voltage level $V_T$ is smaller than the low predetermined voltage level VPL in FIG. 39, but the target voltage level $V_T$ is between the reference voltage level $V_{ref}$ and the low predetermined voltage level VPL in FIG. 40. Therefore, in the embodiment of FIG. 39, the output terminal is pre-charged to the high predetermined voltage level VPH or the low predetermined voltage level VPL in the time period $P_1$ after short the output terminals of the first image data providing apparatus 301 and the second image data providing apparatus 1201. However, in the embodiment of FIG. 40, the output terminal is directly charged to the target voltage level VT without performing pre-charging operations, after short the output terminals of the first image data providing apparatus 301 and the second image data providing apparatus 1201. Via charge sharing, voltage levels for output terminals of image data providing apparatuses can be varied to an average voltage level, such that the range for following charging or pre-charging operations can be decreased to decrease thermal energy or power consumption.

Figure 41:
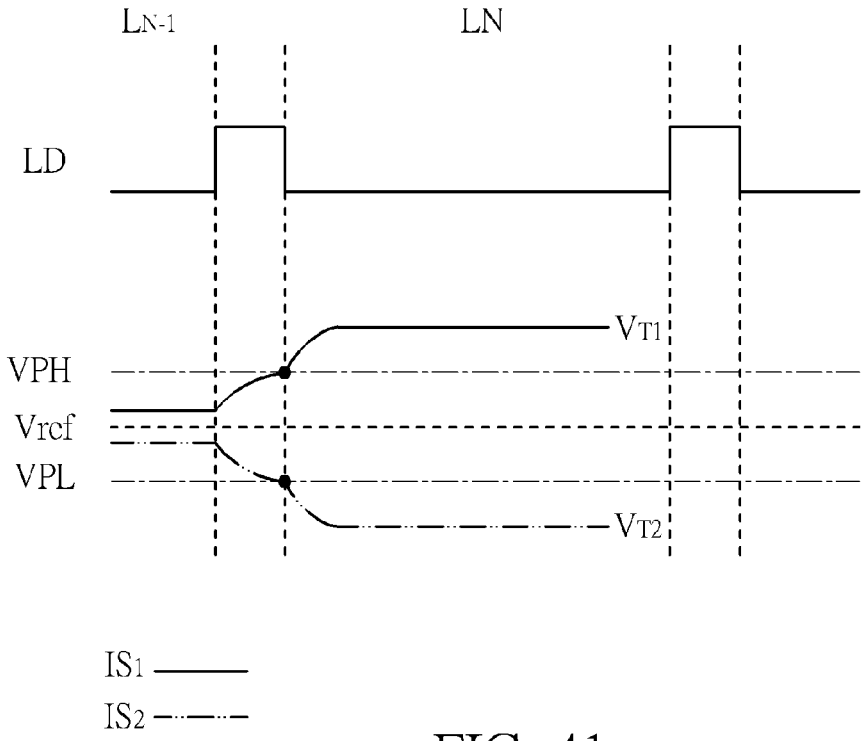
FIG. 41 and FIG. 42 are schematic diagrams illustrating the operation for the two channel source driver according to one embodiment of the present invention when the two channel source driver does not perform polarity inversing.
Figure 42:
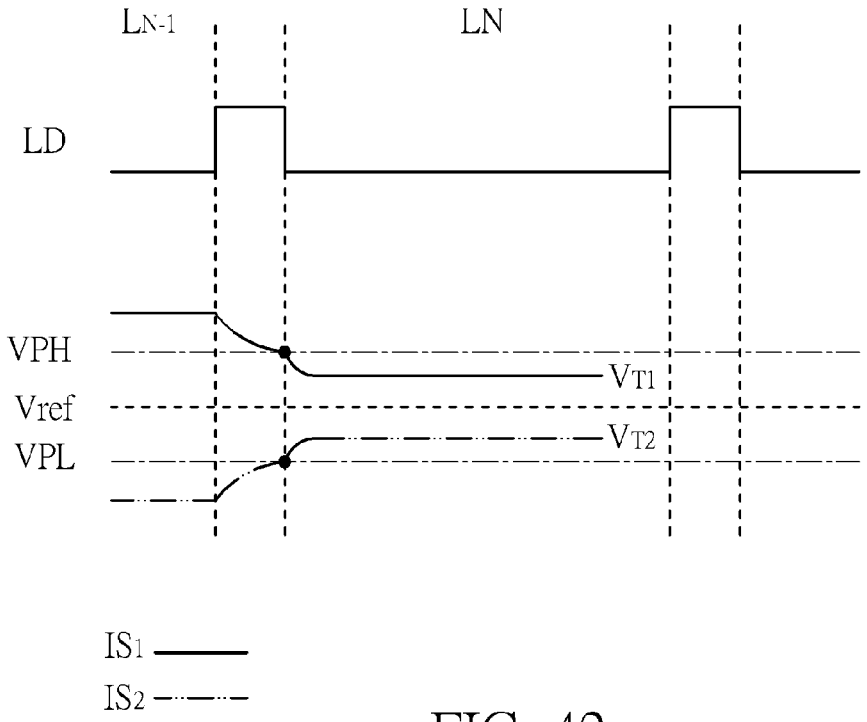

FIG. 41 is a schematic diagram illustrating the operation for the two channel source driver according to one embodiment of the present invention when the two channel source driver does not perform polarity inversing. In the embodiment of FIG. 41, the first image data $IS_1$ is the same as which in FIG. 36, and the second image data $IS_2$ is the same as which in FIG. 37, therefore the pre-charging methods in FIG. 36 and FIG. 37 can be applied to FIG. 41. FIG. 42 is also a schematic diagram illustrating the operation for the two channel source driver according to one embodiment of the present invention when the two channel source driver does not perform polarity inversing. In the embodiment of FIG. 42, the first image data $IS_1$ is the same as which in FIG. 32, and the second image data $IS_2$ is the same as which in FIG. 33, therefore the pre-charging methods in FIG. 32 and FIG. 33 can be applied to FIG. 41. In the embodiments of FIG. 41 and FIG. 42, situations for the first image data $IS_1$ and the second image data $IS_2$ can be swapped, in such case the curves will be swapped as well. The detail for such example can be acquired according to the embodiments of FIG. 41 and FIG. 42, thus it is omitted for brevity here.

Figure 43:
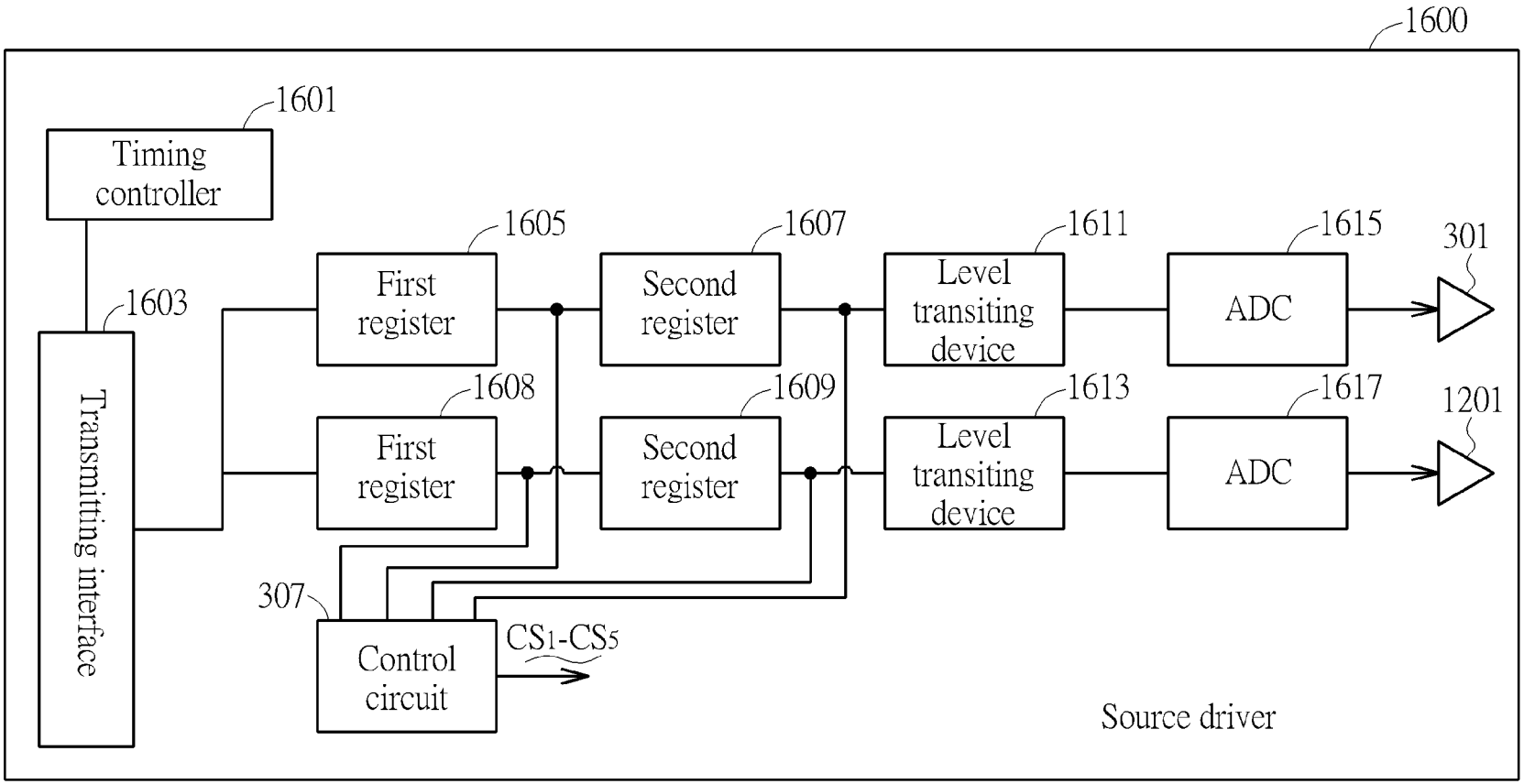
FIG. 43-FIG. 45 are source drivers according different embodiments of the present invention, which have detection controlling circuits at different locations.
Figure 44:
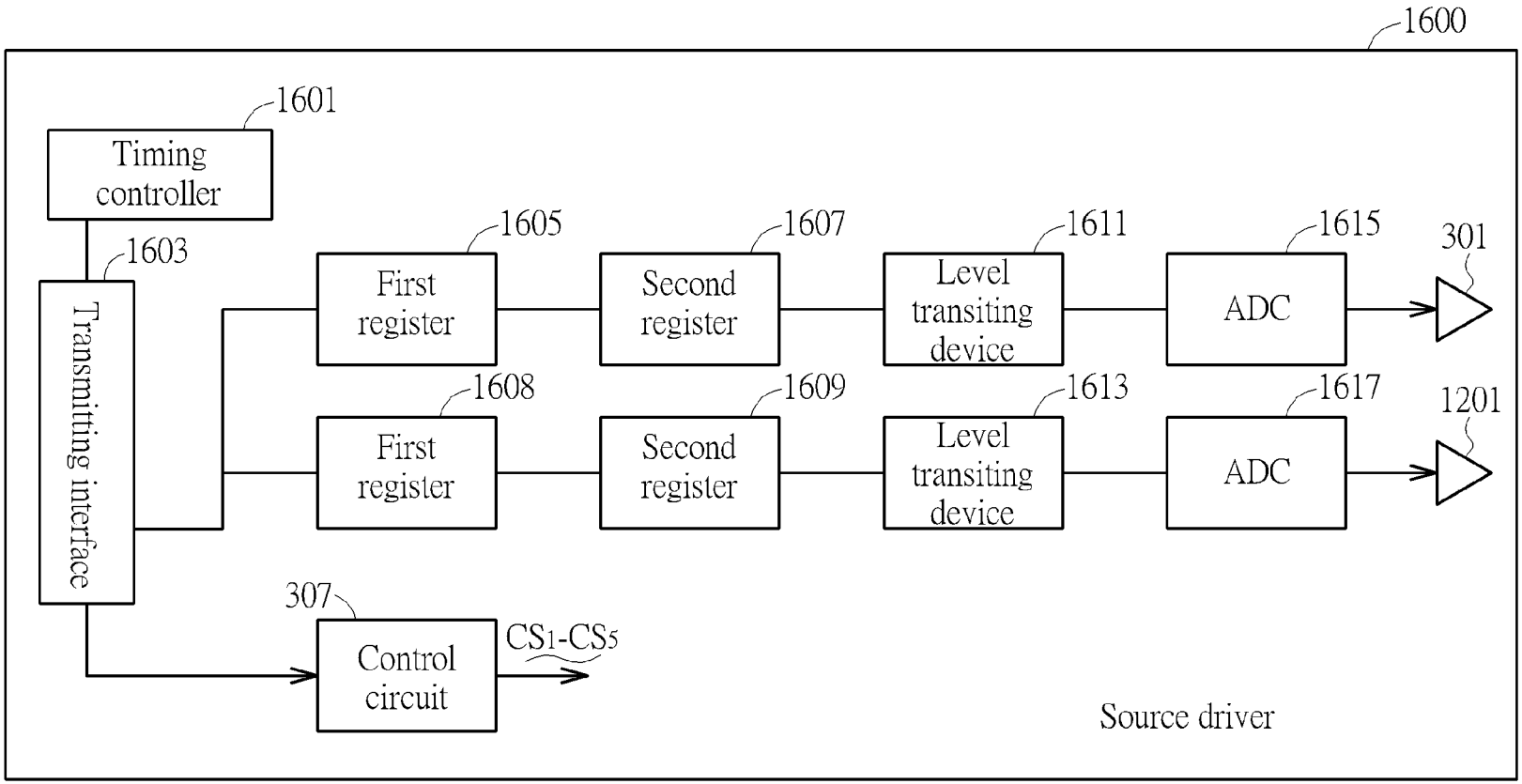
Figure 45:
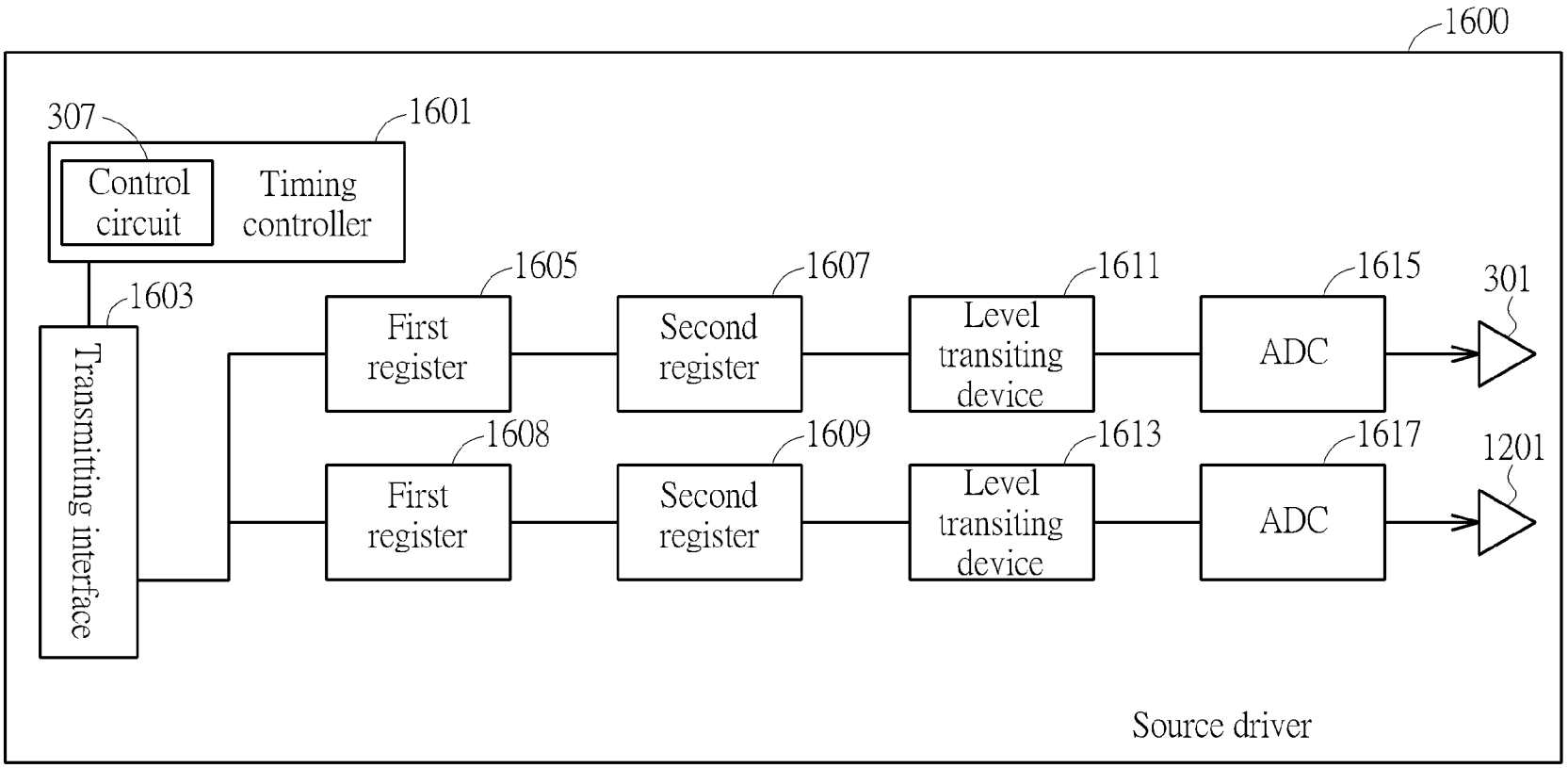

FIG. 43-FIG. 45 are source drivers according different embodiments of the present invention, which have detection controlling circuits at different locations. Please note the structures in FIG. 43 and FIG. 45 are only for example and do not mean to limit the scope of the present invention. As shown in FIG. 43, the source driver 1600 comprises a timing controller 1601, a transmitting interface 1603, first registers 1605,1608, second registers 1607, 1609, level transiting devices 1611, 1613, analog to digital converters 1615, 1617, and the above-mentioned first image data providing apparatus 301 and second image data providing apparatus 1201. Please note some advice for above-mentioned embodiments are not illustrated in FIG. 43 to FIG. 45. The timing controller 1601 is for controlling timings for other devices, and the transmitting interface 1603 is for transmitting image data (also can transmit other signals). The first registers 1605, 1608 register the image data and transmit to the second registers 1607, 1609 until image data for a complete pixel line is formed. The second registers 1607, 1609 output the image data, which will be processed by level transiting devices 1611, 1613, analog to digital converters 1615, 1617, to the first image data providing apparatus 301 and second image data providing apparatus 1201.

Therefore, the input terminal of the detection controlling circuit 307 can be coupled to output terminals of the first registers 1605, 1608 and the second registers 1607, 1609 to acquire image data for different pixel lines, as shown in FIG. 43. Alternatively, the detection controlling circuit 307 can be directly coupled to the transmitting interface 1603 having a plurality of following devices, as shown in FIG. 44. By this way, it can be avoided to locate the detection controlling circuit 307 at the same region of the following devices, such that the space of the chip can be optimally used. Or, the detection controlling circuit 307 can be incorporated into the timing controller 1601, as shown in FIG. 45. In the embodiment show in FIG. 45, firmware can be written into the timing controller 1601 to perform the function of the detection controlling circuit 307.

Figure 46:
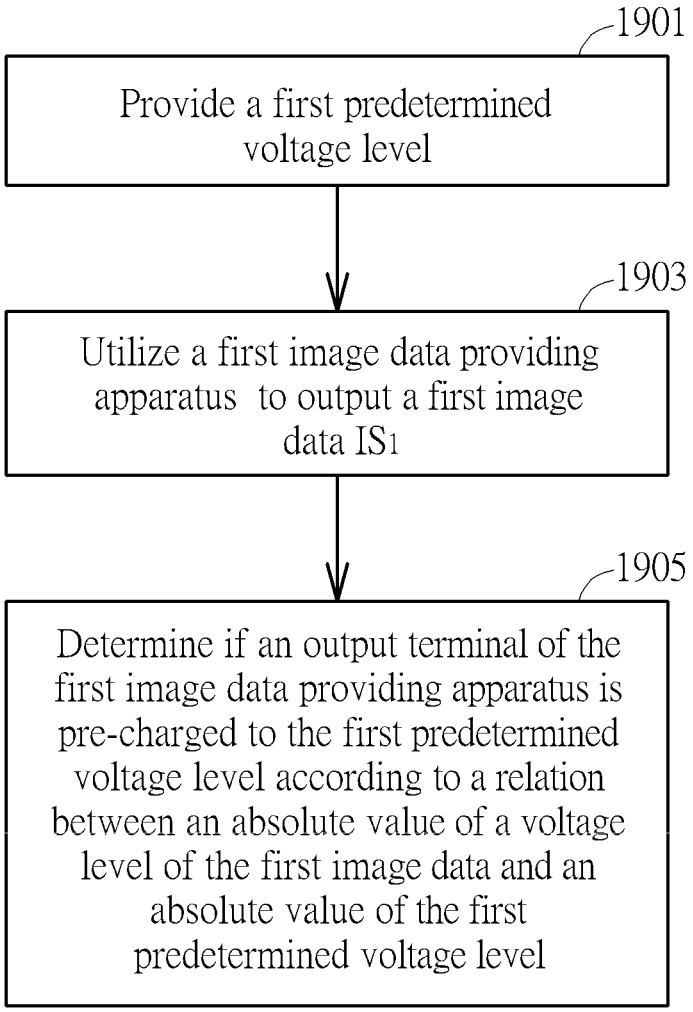
FIG. 46 is a flow chart illustrating a display driving method according to one embodiment of the present invention.

In view of above-mentioned embodiments, a display driving method can be acquired, as show in FIG. 46. The method comprises following steps:

Step 1901

Provide a first predetermined voltage level. For example, one of the high predetermined voltage level VPH, the low predetermined voltage level VPL and reference voltage level $V_{ref}$.

Step 1903

Utilize a first image data providing apparatus (ex. 301 in FIG. 3) to output a first image data $IS_1$.

Step 1905

Determine if an output terminal of the first image data providing apparatus is pre-charged to the first predetermined voltage level according to a relation between an absolute value of a voltage level of the first image data and an absolute value of the first predetermined voltage level. For example, VPH is utilized as the first predetermined voltage level, and the output terminal is pre-charged to VPH.

Such method can further comprise: providing another predetermined voltage, that is, the second predetermined voltage level. In such case, the step 1905 can be varied to comprise the step: Determine if an output terminal of the first image data providing apparatus is pre-charged to another predetermined voltage level according to a relation between an absolute value of a voltage level of the first image data and an absolute value of the first predetermined voltage level. For example, VPH is utilized as the first predetermined voltage level, but the output terminal is pre-charged to VPL. Other detail steps can be acquired via above-mentioned embodiments, thus are omitted for brevity here.

In view of above-mentioned embodiments, the output terminal of the image data providing apparatus can be pre-charged to a predetermined level before the image data providing apparatus outputs the data according to the characteristic of the image data. By this way, the current generated via the charging operation can only flow through a switch rather than flow through a plurality of resistors such as the prior art, thus the generation for thermal energy can be decreased. Also, the charge sharing operation can be performed via the detection controlling circuit, even the polarity inversing is not performed. By this way, the pre-charge operation or charge operation can be more fast.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A display driver, comprising:

a first predetermined voltage level providing apparatus, for providing a first predetermined voltage level group comprising at least one first predetermined voltage level;

a first image data providing apparatus, for outputting a first image data to an output terminal of the first image data providing apparatus; and a detection controlling circuit, for receiving and determining when the output terminal of the first image data providing apparatus is pre-charged to the first predetermined voltage level according to a relationship between an absolute value of a voltage level of the first image data and an absolute value of the first predetermined voltage level.

2. The display driver of claim 1, wherein the detection controlling circuit pre-charges the output terminal of the first image data providing apparatus to the first predetermined voltage level when the absolute value of the voltage level of the first image data is larger than the absolute value of the first predetermined voltage level.

3. The display driver of claim 2, further comprising:

a second predetermined voltage level providing apparatus, for providing a second predetermined voltage level group comprising at least one second predetermined voltage level, wherein a polarity of the second predetermined voltage level is opposite to which of the first predetermined voltage level;

a reference voltage level providing apparatus, for providing a reference voltage level, wherein the reference voltage level is between the first predetermined voltage level and the second predetermined voltage level;

wherein the detection controlling circuit charges the output terminal of the first image data providing apparatus to a target voltage level after pre-charges the output terminal to the first predetermined voltage level, wherein the target voltage level is between the second predetermined voltage level and the reference voltage level.

4. The display driver of claim 2, further comprising:

a second predetermined voltage level providing apparatus, for providing a second predetermined voltage level group comprising at least one second predetermined voltage level, wherein a polarity of the second predetermined voltage level is opposite to the first predetermined voltage level;

wherein the detection controlling circuit further charges the output terminal of the first image data providing apparatus to a target voltage level after pre-charging the output terminal to the first predetermined voltage level, wherein an absolute value of the target voltage level is larger than the second predetermined voltage level.

5. The display driver of claim 2, further comprising:

a high predetermined voltage level providing apparatus, for providing a high predetermined voltage level group comprising at least one high predetermined voltage level;

a low predetermined voltage level providing apparatus, for providing a low predetermined voltage level group comprising at least one low predetermined voltage level, wherein a polarity of the high predetermined voltage level is opposite to which of the low predetermined voltage level;

wherein the first predetermined voltage level is one of the high predetermined voltage level and the low predetermined voltage level.

6. The display driver of claim 5, further comprising:

a reference voltage level providing apparatus, for providing a reference voltage level, wherein the reference voltage level is between the first predetermined voltage level and the second predetermined voltage level;

wherein the detection controlling circuit charges the output terminal of the first image data providing apparatus to the reference voltage level after pre-charging the output terminal to the first predetermined voltage level, then pre-charging the output terminal to the second predetermined voltage level, and then charges the output terminal to a target voltage level.

7. The display driver of claim 5, further comprising:

a reference voltage level providing apparatus, for providing a reference voltage level, wherein the reference voltage level is between the first predetermined voltage level and the second predetermined voltage level;

wherein the detection controlling circuit charges the output terminal of the first image data providing apparatus to one of the reference voltage level and the second predetermined voltage level after pre-charging the output terminal to the first predetermined voltage level, then pre-charging the output terminal to the second predetermined voltage level, and then charges the output terminal to a target voltage level.

8. The display driver of claim 2, further comprising:

a high predetermined voltage level providing apparatus, for providing a high predetermined voltage level group comprising at least one high predetermined voltage level;

a low predetermined voltage level providing apparatus, for providing a low predetermined voltage level group comprising at least one low predetermined voltage level;

a reference voltage level providing apparatus, for providing a reference voltage level as the first predetermined voltage level, wherein the reference voltage level is between the high predetermined voltage level and the low predetermined voltage level.

9. The display driver of claim 8, wherein the detection controlling circuit charges the output terminal of the first image data providing apparatus to one of the high predetermined voltage level and the low predetermined voltage level after pre-charges the output terminal to the first predetermined voltage level, and then charges the output terminal to a target voltage level.

10. The display driver of claim 2, applied to a LCD comprising at least one liquid crystal device, wherein the detection controlling circuit only pre-charges the output terminal of the first image data providing apparatus to the first predetermined voltage level when polarities the liquid crystal device are inversed.

11. The display driver of claim 1, applied to a LCD comprising a plurality of pixel lines, wherein the detection controlling circuit pre-charges the output terminal of the first image data providing apparatus to the first predetermined voltage level when one of the following conditions is met:

an absolute value for a voltage level of image data of a previous pixel line is smaller than the first predetermined voltage level, and an absolute value for a voltage level of the image data of a current pixel line is larger than the first predetermined voltage level; and the absolute value for the voltage level of image data of the previous pixel line is larger than the first predetermined voltage level, and the absolute value for the voltage level of the image data of the current pixel line is smaller than the first predetermined voltage level.

12. The display driver of claim 11, applied to a LCD comprising at least one liquid crystal device, wherein the detection controlling circuit only pre-charges the output terminal of the first image data providing apparatus to the first predetermined voltage level when polarities the liquid crystal device are not inversed.

13. The display driver of claim 1, applied to a LCD comprising a plurality of pixel lines, wherein the display driver comprises:

a high predetermined voltage level providing apparatus, for providing a high predetermined voltage level group comprising at least one high predetermined voltage level;

a low predetermined voltage level providing apparatus, for providing a low predetermined voltage level group comprising at least one low predetermined voltage level, wherein a polarity of the high predetermined voltage level is opposite to which of the low predetermined voltage level, and the first predetermined voltage level is one of the high predetermined voltage level and the low predetermined voltage level;

a reference voltage level providing apparatus, for providing a reference voltage level as the first predetermined voltage level, wherein the reference voltage level is between the high predetermined voltage level and the low predetermined voltage level;

wherein the detection controlling circuit pre-charges the output terminal of the first image data providing apparatus to the reference voltage level when conditions (a) and (b) are met:

(a) an absolute value for a voltage level of image data of a previous pixel line is larger than which of the first predetermined voltage level, and an absolute value for a voltage level of the image data of a current pixel line is smaller than which of the first predetermined voltage level;

(b) a difference between the absolute value for the voltage level of the image data of the current pixel line and the absolute value of the reference voltage is smaller than a difference between the absolute value for the voltage level of the image data of the current pixel line and the first predetermined voltage level.

14. The display driver of claim 1, applied to a LCD comprising a plurality of image pixel lines, wherein the display driver further comprises:

a second image data providing apparatus, for outputting a second image data;

wherein the detection controlling circuit shorts the output terminal of the first image data providing apparatus and an output terminal of the second image data providing apparatus when a following condition is met:

an absolute value for a voltage level of image data of a previous pixel line is larger than which of the first predetermined voltage level, and an absolute value for a voltage level of the image data of a current pixel line is smaller than which of the first predetermined voltage level.

15. The display driver of claim 14, applied to a LCD comprising at least one liquid crystal device, wherein the detection controlling circuit only shorts the output terminals of the first image data providing apparatus and the second image data providing apparatus when polarities the liquid crystal device are not inversed.

16. The display driver of claim 14, comprising:

a second image data providing apparatus, for outputting a second image data;

wherein the detection controlling circuit generates a data reading signal including a first logic level and a second logic level to the first image data providing apparatus, where a time period for the first logic level is smaller than which of the second logic level;

wherein the detection controlling circuit shorts the output terminals of the first image data providing apparatus and the second image data providing apparatus when the data reading signal has the first logic value, and then pre-charges the output terminal of the first image data providing apparatus to the first predetermined voltage level.

17. The display driver of claim 1, wherein the detection controlling circuit generates a data reading signal including a first logic level and a second logic level to the first image data providing apparatus, where a time period for the first logic level is smaller than which of the second logic level, wherein the detection controlling circuit pre-charges the output terminal of the first image data providing apparatus to the first predetermined voltage level when the data reading signal has the first logic value; where the first image data providing apparatus outputs the first image data when the data reading signal has the second logic value.

18. The display driver of claim 1, being a source driver, wherein the first image data providing apparatus is an amplifier.

19. The display driver of claim 1, applied to a LCD comprising a plurality of pixel lines, wherein the display driver further comprises:

a first register, for registering image data for one of the pixel lines, and for outputting the image data when the registered image data form a complete pixel line; and a second register, for receiving the image data output from the first register, and for outputting the image data to the first image data providing apparatus;

wherein the detection controlling circuit is coupled to output terminals of the first register and the second register.

20. The display driver of claim 1, further comprising:

a register, for registering image for one of the pixel lines, and for outputting the image data when the registered image data form a complete pixel line; and a transmitting interface, for outputting the image data to the register;

wherein the detection controlling circuit is coupled to the transmitting interface.

21. The display driver of claim 1, further comprising:

a timing detection controlling circuit, for controlling timing of the display driver, wherein the detection controlling circuit is incorporated into the timing detection controlling circuit.

22. A display driver, comprising:

a first predetermined voltage level providing apparatus, for providing a first predetermined voltage level group comprising at least one first predetermined voltage level;

a second predetermined voltage level providing apparatus, for providing a second predetermined voltage level group comprising at least one second predetermined voltage level, wherein a polarity of the second predetermined voltage level is opposite to which of the first predetermined voltage level, or an absolute value of the second predetermined voltage level is smaller than which of the first predetermined voltage level;

a first image data providing apparatus, for outputting a first image data to an output terminal of the first image data providing apparatus; and a detection controlling circuit, for receiving and determining when the if an output terminal of the first image data providing apparatus is pre-charged to the second predetermined voltage level according to a relationship between an absolute value of a voltage level of the first image data and an absolute value of the first predetermined voltage level.

23. The display driver of claim 22, further comprising:

a reference voltage level providing apparatus, for providing a reference voltage level, wherein the polarity of the second predetermined voltage level is opposite to which of the first predetermined voltage level, wherein the reference voltage level is between the first predetermined voltage level and the second predetermined voltage level;

wherein the detection controlling circuit charges the output terminal of the first image data providing apparatus to a target voltage level after pre-charges the output terminal to the second predetermined voltage level, wherein the target voltage level is between the second predetermined voltage level and the reference voltage level.

24. The display driver of claim 22, further comprising:

a reference voltage level providing apparatus, for providing a reference voltage level, wherein the polarity of the second predetermined voltage level is opposite to which of the first predetermined voltage level, wherein the reference voltage level is between the first predetermined voltage level and the second predetermined voltage level;

wherein the detection controlling circuit charges the output terminal of the first image data providing apparatus to a target voltage level after pre-charges the output terminal to the second predetermined voltage level, wherein an absolute value of the target voltage level is larger than which of the second predetermined voltage level.

25. The display driver of claim 22, further comprising:

a high predetermined voltage level providing apparatus, for providing a high predetermined voltage level group comprising at least one high predetermined voltage level;

a low predetermined voltage level providing apparatus, for providing a low predetermined voltage level group comprising at least one low predetermined voltage level, wherein a polarity of the high predetermined voltage level is opposite to which of the low predetermined voltage level;

wherein the first predetermined voltage is one of the high predetermined voltage level and the low predetermined voltage level, and the second predetermined voltage level is the other one of the high predetermined voltage level and the low predetermined voltage level.

26. The display driver of claim 22, further comprising:

a high predetermined voltage level providing apparatus, for providing a high predetermined voltage level group comprising at least one high predetermined voltage level;

a low predetermined voltage level providing apparatus, for providing a low predetermined voltage level group comprising at least one low predetermined voltage level, wherein a polarity of the high predetermined voltage level is opposite to which of the low predetermined voltage level;

a reference voltage level providing apparatus, for providing a reference voltage level as the second predetermined voltage level, wherein the reference voltage level is between the high predetermined voltage level and the low predetermined voltage level, where the first predetermined voltage is one of the high predetermined voltage level and the low predetermined voltage level.

27. The display driver of claim 26, wherein the detection controlling circuit pre-charges the output terminal to one of the high predetermined voltage level and the low predetermined voltage level, which is not the first predetermined voltage level, after pre-charges the output terminal to the second predetermined voltage level, and then charges the output terminal to a target voltage level.

28. The display driver of claim 22, further comprising:

a high predetermined voltage level providing apparatus, for providing a high predetermined voltage level group comprising at least one high predetermined voltage level;

a low predetermined voltage level providing apparatus, for providing a low predetermined voltage level group comprising at least one low predetermined voltage level, wherein a polarity of the high predetermined voltage level is opposite to which of the low predetermined voltage level;

a reference voltage level providing apparatus, for providing a reference voltage level as the first predetermined voltage level, wherein the reference voltage level is between the high predetermined voltage level and the low predetermined voltage level, where the second predetermined voltage is one of the high predetermined voltage level and the low predetermined voltage level.

29. A display driving method, comprising:

providing a first predetermined voltage level group comprising at least one first predetermined voltage level;

utilizing a first image data providing apparatus to output a first image data to an output terminal of the first image data providing apparatus; and receiving and determining when the output terminal of the first image data providing apparatus is pre-charged to the first predetermined voltage level according to a relationship between an absolute value of a voltage level of the first image data and an absolute value of the first predetermined voltage level.

30. The display driving method of claim 29, further comprising pre-charging the output terminal of the first image data providing apparatus to the first predetermined voltage level when the absolute value of the voltage level of the first image data is larger than the absolute value of the first predetermined voltage level.

31. The display driving method of claim 30, further comprising:

providing a second predetermined voltage level group comprising at least one second predetermined voltage level, wherein a polarity of the second predetermined voltage level is opposite to which of the first predetermined voltage level;

providing a reference voltage level, wherein the reference voltage level is between the first predetermined voltage level and the second predetermined voltage level; and charging the output terminal of the first image data providing apparatus to a target voltage level after pre-charging the output terminal to the first predetermined voltage level, wherein the target voltage level is between the second predetermined voltage level and the reference voltage level.

32. The display driving method of claim 30, further comprising:

providing a second predetermined voltage level group comprising at least one second predetermined voltage level, wherein a polarity of the second predetermined voltage level is opposite to the first predetermined voltage level;

charging the output terminal of the first image data providing apparatus to a target voltage level after pre-charging the output terminal to the first predetermined voltage level, wherein an absolute value of the target voltage level is larger than the second predetermined voltage level.

33. The display driving method of claim 30, further comprising:

providing a high predetermined voltage level group comprising at least one high predetermined voltage level;

providing a low predetermined voltage level group comprising at least one low predetermined voltage level, wherein a polarity of the high predetermined voltage level is opposite to which of the low predetermined voltage level;

utilizing one of the high predetermined voltage level and the low predetermined voltage level as the first predetermined voltage level.

34. The display driving method of claim 33, further comprising:

providing a reference voltage level, wherein the reference voltage level is between the first predetermined voltage level and the second predetermined voltage level;

charging the output terminal of the first image data providing apparatus to the reference voltage level after pre-charging the output terminal to the first predetermined voltage level, then pre-charging the output terminal to the second predetermined voltage level, and then charging the output terminal to a target voltage level.

35. The display driving method of claim 33, further comprising:

providing a reference voltage level, wherein the reference voltage level is between the first predetermined voltage level and the second predetermined voltage level;

charging the output terminal of the first image data providing apparatus to one of the reference voltage level and the second predetermined voltage level after pre-charging the output terminal to the first predetermined voltage level, then pre-charging the output terminal to the second predetermined voltage level, and then charging the output terminal to a target voltage level.

36. The display driving method of claim 30, further comprising:

providing a high predetermined voltage level group comprising at least one high predetermined voltage level;

providing a low predetermined voltage level group comprising at least one low predetermined voltage level;

providing a reference voltage level as the first predetermined voltage level, wherein the reference voltage level is between the high predetermined voltage level and the low predetermined voltage level.

37. The display driving method of claim 36, further comprising charging the output terminal of the first image data providing apparatus to one of the high predetermined voltage level and the low predetermined voltage level after pre-charging the output terminal to the first predetermined voltage level, and then charging the output terminal to a target voltage level.

38. The display driving method of claim 30, applied to a LCD comprising at least one liquid crystal device, wherein the display driving method comprises: only pre-charging the output terminal of the first image data providing apparatus to the first predetermined voltage level when polarities the liquid crystal device are inversed.

39. The display driving method of claim 29, applied to a LCD comprising a plurality of pixel lines, wherein the display driving method pre-charges the output terminal of the first image data providing apparatus to the first predetermined voltage level when one of the following conditions is met:

an absolute value for a voltage level of image data of a previous pixel line is smaller than which of the first predetermined voltage level, and an absolute value for a voltage level of the image data of a current pixel line is larger than which of the first predetermined voltage level; and the absolute value for the voltage level of image data of the previous pixel line is larger than which of the first predetermined voltage level, and the absolute value for the voltage level of the image data of the current pixel line is smaller than which of the first predetermined voltage level.

40. The display driving method of claim 39, applied to a LCD comprising at least one liquid crystal device, wherein the display driving method only pre-charges the output terminal of the first image data providing apparatus to the first predetermined voltage level when polarities the liquid crystal device are not inversed.

41. The display driving method of claim 29, applied to a LCD comprising a plurality of pixel lines, wherein the display driving method comprises:

providing a high predetermined voltage level group comprising at least one high predetermined voltage level;

providing a low predetermined voltage level group comprising at least one low predetermined voltage level, wherein a polarity of the high predetermined voltage level is opposite to which of the low predetermined voltage level, and the first predetermined voltage level is one of the high predetermined voltage level and the low predetermined voltage level;

providing a reference voltage level as the first predetermined voltage level, wherein the reference voltage level is between the high predetermined voltage level and the low predetermined voltage level;

pre-charging the output terminal of the first image data providing apparatus to the reference voltage level when conditions (a) and (b) are met:

(a) an absolute value for a voltage level of image data of a previous pixel line is larger than which of the first predetermined voltage level, and an absolute value for a voltage level of the image data of a current pixel line is smaller than which of the first predetermined voltage level;

(b) a difference between the absolute value for the voltage level of the image data of the current pixel line and the absolute value of the reference voltage is smaller than a difference between the absolute value for the voltage level of the image data of the current pixel line and the first predetermined voltage level.

42. The display driving method of claim 29, applied to a LCD comprising a plurality of image pixel lines, wherein the display driver further comprises:

utilizing a second image data providing apparatus to output a second image data;

shorting the output terminal of the first image data providing apparatus and an output terminal of the second image data providing apparatus when a following condition is met:

an absolute value for a voltage level of image data of a previous pixel line is larger than which of the first predetermined voltage level, and an absolute value for a voltage level of the image data of a current pixel line is smaller than which of the first predetermined voltage level.

43. The display driving method of claim 42, applied to a LCD comprising at least one liquid crystal device, wherein the display driving method only shorts the output terminals of the first image data providing apparatus and the second image data providing apparatus when polarities the liquid crystal device are not inversed.

44. The display driving method of claim 42, comprising:

utilizing a second image data providing apparatus to output a second image data;

generating a data reading signal including a first logic level and a second logic level to the first image data providing apparatus, where a time period for the first logic level is smaller than which of the second logic level;

wherein the display driving method shorts the output terminals of the first image data providing apparatus and the second image data providing apparatus when the data reading signal has the first logic value, and then pre-charges the output terminal of the first image data providing apparatus to the first predetermined voltage level.

45. The display driving method of claim 29, comprising generating a data reading signal including a first logic level and a second logic level to the first image data providing apparatus, where a time period for the first logic level is smaller than which of the second logic level, wherein the display driving method pre-charges the output terminal of the first image data providing apparatus to the first predetermined voltage level when the data reading signal has the first logic value; where the first image data providing apparatus is controlled to output the first image data when the data reading signal has the second logic value.

46. A display driver, comprising:

providing a first predetermined voltage level group comprising at least one first predetermined voltage level;

providing a second predetermined voltage level group comprising at least one second predetermined voltage level, wherein a polarity of the second predetermined voltage level is opposite to which of the first predetermined voltage level, or an absolute value of the second predetermined voltage level is smaller than which of the first predetermined voltage level;

utilizing a first image data providing apparatus to output a first image data to an output terminal of the first image data providing apparatus; and receiving and determining when the output terminal of the first image data providing apparatus is pre-charged to the second predetermined voltage level according to a relationship between an absolute value of a voltage level of the first image data and an absolute value of the first predetermined voltage level.

47. The display driving method of claim 46, further comprising:

providing a reference voltage level, wherein the polarity of the second predetermined voltage level is opposite to which of the first predetermined voltage level, wherein the reference voltage level is between the first predetermined voltage level and the second predetermined voltage level; and charging the output terminal of the first image data providing apparatus to a target voltage level after pre-charging the output terminal to the second predetermined voltage level, wherein the target voltage level is between the second predetermined voltage level and the reference voltage level.

48. The display driving method of claim 46, further comprising:

providing a reference voltage level, wherein the polarity of the second predetermined voltage level is opposite to which of the first predetermined voltage level, wherein the reference voltage level is between the first predetermined voltage level and the second predetermined voltage level;

charging the output terminal of the first image data providing apparatus to a target voltage level after pre-charging the output terminal to the second predetermined voltage level, wherein an absolute value of the target voltage level is larger than which of the second predetermined voltage level.

49. The display driving method of claim 46, further comprising:

providing a high predetermined voltage level group comprising at least one high predetermined voltage level;

providing a low predetermined voltage level group comprising at least one low predetermined voltage level, wherein a polarity of the high predetermined voltage level is opposite to which of the low predetermined voltage level;

wherein the first predetermined voltage is one of the high predetermined voltage level and the low predetermined voltage level, and the second predetermined voltage level is the other one of the high predetermined voltage level and the low predetermined voltage level.

50. The display driving method of claim 46, further comprising:

providing a high predetermined voltage level group comprising at least one high predetermined voltage level;

providing a low predetermined voltage level group comprising at least one low predetermined voltage level, wherein a polarity of the high predetermined voltage level is opposite to which of the low predetermined voltage level;

providing a reference voltage level as the second predetermined voltage level, wherein the reference voltage level is between the high predetermined voltage level and the low predetermined voltage level, where the first predetermined voltage is one of the high predetermined voltage level and the low predetermined voltage level.

51. The display driving method of claim 50, further comprising:

pre-charging the output terminal to one of the high predetermined voltage level and the low predetermined voltage level, which is not the first predetermined voltage level, after pre-charging the output terminal to the second predetermined voltage level, and then charging the output terminal to a target voltage level.

52. The display driving method of claim 46, further comprising:

providing a high predetermined voltage level group comprising at least one high predetermined voltage level;

providing a low predetermined voltage level group comprising at least one low predetermined voltage level, wherein a polarity of the high predetermined voltage level is opposite to which of the low predetermined voltage level;

providing a reference voltage level as the first predetermined voltage level, wherein the reference voltage level is between the high predetermined voltage level and the low predetermined voltage level, where the second predetermined voltage is one of the high predetermined voltage level and the low predetermined voltage level.

53. The display driver of claim 1, wherein the display driver is a source driver.

54. The display driver of claim 22, wherein the display driver is a source driver.

55. The display driving method of claim 29, wherein the display driving method is applied to a source driver.

56. The display driving method of claim 46, wherein the display driving method is applied to a source driver.

* * * * *